US012185768B2

(12) United States Patent
Hall

(10) Patent No.: US 12,185,768 B2
(45) Date of Patent: Jan. 7, 2025

(54) GENITAL CONCEALING UNDERWEAR FOR TRANS FEMALE GENDER PRESENTATION

(71) Applicant: Martha Hall, Newark, DE (US)

(72) Inventor: Martha Hall, Newark, DE (US)

(73) Assignee: University of Delaware, Newark, DE (US)

( * ) Notice: Subject to any disclaimer, the term of this patent is extended or adjusted under 35 U.S.C. 154(b) by 0 days.

(21) Appl. No.: 18/013,973

(22) PCT Filed: Jun. 30, 2021

(86) PCT No.: PCT/US2021/039867
§ 371 (c)(1),
(2) Date: Dec. 30, 2022

(87) PCT Pub. No.: WO2022/006257
PCT Pub. Date: Jan. 6, 2022

(65) Prior Publication Data

US 2023/0284709 A1 Sep. 14, 2023

Related U.S. Application Data

(60) Provisional application No. 63/045,964, filed on Jun. 30, 2020.

(51) Int. Cl.
*A41B 9/04* (2006.01)
*A41B 9/00* (2006.01)
*A41B 9/02* (2006.01)

(52) U.S. Cl.
CPC ..... *A41B 9/04* (2013.01); *A41B 9/004* (2013.01); *A41B 9/02* (2013.01)

(58) Field of Classification Search
CPC .... A41B 9/00; A41B 9/02; A41B 9/04; A41B 9/06
(Continued)

(56) References Cited

U.S. PATENT DOCUMENTS 1,458,892 A 6/1923 Moffat
7,685,651 B2 3/2010 Yoo
(Continued)

FOREIGN PATENT DOCUMENTS

KR 100489346 B1 5/2005
WO 2015156686 A2 10/2015

OTHER PUBLICATIONS

International Search Report and Written Opinion for International Application No. PCT/US2021/039867, dated Oct. 6, 2021, 11 pages.

(Continued)

*Primary Examiner* — Gloria M Hale
(74) *Attorney, Agent, or Firm* — Buchanan Ingersoll & Rooney PC

(57) ABSTRACT

Garments for concealing male genitalia of a wearer, the garment having a compressible region configured to be disposed over the genitalia of the wearer. Adjustment of tensile forces exerted on the compressible region resolve to compression forces exerted by the compressible region on the wearer's genitalia. Embodiments include garments having a primary portion and a connector portion configured to connect a front portion to a back portion, the connector having an adjustable length between a connection to the front portion and connection to the back portion, wherein adjustment of the length is used for adjusting the tensile forces.

20 Claims, 24 Drawing Sheets

(58) Field of Classification Search
USPC ..... 2/400, 403
See application file for complete search history.

(56) References Cited

U.S. PATENT DOCUMENTS

| | | | | |
|---|---|---|---|---|
| 11,553,739 | B2 * | 1/2023 | Henry | A41D 1/08 |
| 2005/0075046 | A1 | 4/2005 | Williams | |
| 2015/0223524 | A1 | 8/2015 | Brady | |
| 2016/0316833 | A1 | 11/2016 | Bruce | |
| 2020/0323287 | A1 * | 10/2020 | Bleistern | A41D 27/12 |
| 2022/0256936 | A1 * | 8/2022 | Hall | A41D 27/12 |

OTHER PUBLICATIONS

Abbey et al., (1987). "The effects of clothing and dyad sex composition on perceptions of sexual intent: Do women and men evaluate these cues differently", Journal of Applied Social Psychology, 17(2), 108-126.
Altay, B., (2014). "User-centered design through learner-centered instruction", Teaching in Higher Education, 19(2), 138-155.
Beasley et al., (2002). "Shirts vs. skins: Clothing as an indicator of gender role stereotyping in video games", Mass Communication & Society, 5(3), 279-293.
Bem, S., (1974). "The measurement of psychological androgyny", Journal of Consulting and Clinical Psychology, 42(2), 155-162.
Berghausen, M., (2011). "Intersex employment discrimination: Title vii and anatomical sex nonconformity", Northwestern University Law Review, 105(3), 1281-1316.
Black, A., (2016). "High fashion and projection of transgender bodies: Queer strategy in the Barneys New York Spring 2014 Campaign", Proceedings of the 2016 Conference of the American Academy of Advertising, 2016, 214-225.
Boncori et al., (May 30, 2019). "Half of transgender and non-binary people hide their identity at work in fear of discrimination", Retrieved Oct. 9, 2019, from https://phys.org/news/2019-05-transgender-non-binary-people-identity-discrimination.html, 5 pages.
Butler, T., (Apr. 2, 2019). "Transgender population in the US.", Retrieved Oct. 9, 2019, from https://www.pinknews.co.uk/2019/04/02/percentage-us-population-transgender-statistics/, 8 pages.
Chrisman-Campbell, K., (2015). "A Brief History of Unisex Fashion", The Atlantic, 14, 11 pages.
Christel et al., (2016). "Coping by crossdressing: An exploration of exercise clothing for obese heterosexual women", Fashion and Textiles: International Journal of Interdisciplinary Research, 3(1), 1-19.
Diamond, L., (2009). "Tech program may be redesigned", The Atlanta Journal-Constitution (Atlanta, GA), B1, 1, 6 pages.
Egan et al., (2001). "Gender identity: A multidimensional analysis with implications for psychosocial adjustment", Developmental Psychology, 37(4), 451-463.
Eisenstadt, L. F., (2015). "Fluid identity discrimination", American Business Law Journal, 52(4), 789-857.
Graybill et al., (2016). "Lesbian, gay, bisexual, and transgender youth: Limited representation in school support personnel journals", Journal of School Psychology, 54, 9-16.
Greene, D. W., (2013). "Categorically black, white, or wrong: Misperception discrimination and the state of title vii protection", U. Mich. JL Reform, 47, 87, 81 pages.
Hoffmann, J., (Aug. 21, 2019). "Key Benefits of Effective Feedback", HR Aligned Design Blog, Retrieved Oct. 9, 2019, from https://hraligneddesign.com/leadership/key-benefits-of-effective-feedback/, 3 pages.
Holton, J. A., (2007). "The coding process and its challenges", In A. Bryant, & K. Charmaz (Eds.), The Sage handbook of grounded theory, 265-289.
Iannacci, E., (2011). "The new transsexual chic: Trans are front and centre in the fashion world these days. but for how long?", Maclean's, 124(10), 57, 3 pages.
Ishii et al., (2019). "The effect of pink/blue clothing on implicit and explicit gender-related self-cognition and attitudes among men", Japanese Psychological Research, 61(2), 123-132.
Jordan, P., (2017). "Gender fluidity in men's fashion: From Shakespeare's modern English to the new millennium", Critical Studies in Men's Fashion, 4(2), 171-184.
Kpamma et al., (2016). "An exploration of the choosing by advantages decision system as a user engagement tool in participatory design", Architectural Engineering and Design Management, 12(1), 51-66.
Luchs-et al., (2016). "Perspective: A review of marketing research on product design with directions for future research", Journal of Product Innovation Management, 33(3), 320-341.
Murnen et al., (2016). "Boys act and girls appear: A content analysis of gender stereotypes associated with characters in children's popular culture", Sex Roles: A Journal of Research, 74(1-2), 78-91.
Navarro et al., (2014). "Impact of gender and the stereotyped nature of illustrations on choice of color: Replica of the study by Karniol (2011) in a Spanish sample", Gender Issues, 31(2), 142-162.
Newfield et al., (2006). "Female-to-male transgender quality of life", Quality of Life Research, 15(9), 1447-1457.
Sayfouri, N., (2014). "An alternative method of literature review: Systematic review in English language teaching research", Procedia—Social and Behavioral Sciences, 98, 1693-1697.
Steensma et al., (2013). "Gender identity development in adolescence", Hormones and Behavior, 64(2), 288-297.
Stokes et al., (2012). "Application of the functional, expressive and aesthetic consumer needs model: Assessing the clothing needs of adolescent girls with disabilities", International Journal of Fashion Design, Technology and Education, 5(3), 179-186.
Urquhart, C., (2012). "Grounded theory for qualitative research: A practical guide", Sage Publications, 23 pages.
Vincent, K., (2013). "The advantages of repeat interviews in a study with pregnant schoolgirls and schoolgirl mothers: Piecing together the jigsaw", International Journal of Research & Method in Education, 36(4), 341-354.
Walker, A. R., (2011). "Choosing to be multiracial in America: The sociopolitical implications of the check all that apply approach to race adopted in the 2000 US Census", Berkeley La Raza LJ, 21, 61, 32 pages.
Wang et al., (2016). "Virtual space co-creation: The perspective of user innovation", Journal of Organizational and End User Computing (JOEUC), 28(2), 92-106.
Winter, D., (2004). "GLBT market can't be ignored", Ward's Auto World, 40(4), 5, 4 pages.
International Preliminary Report on Patentability for International Application No. PCT/US2021/039867, dated Dec. 13, 2022, 11 pages.

* cited by examiner

FIG.10A
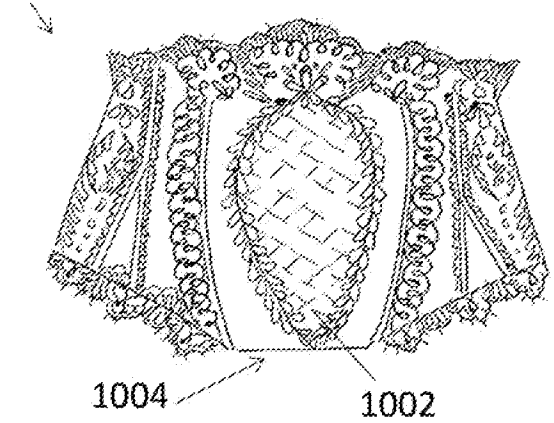
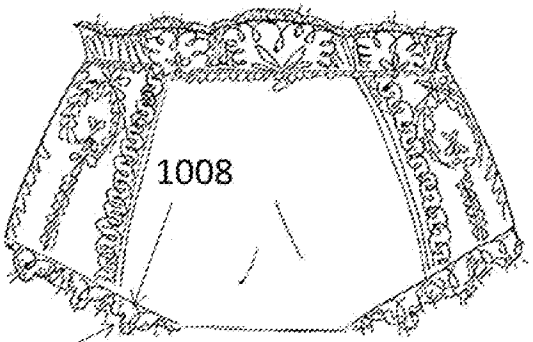
FIG. 10B
FIG. 9A
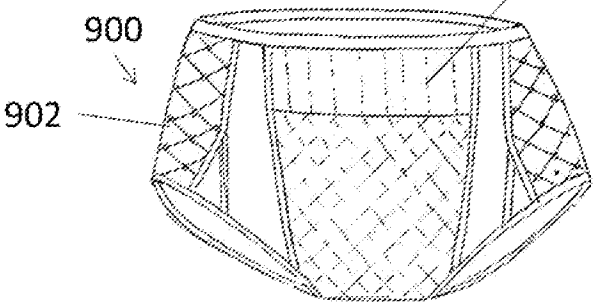
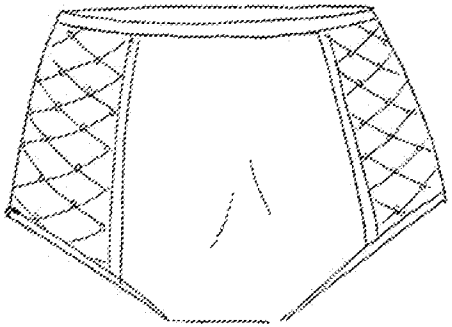
FIG. 9B

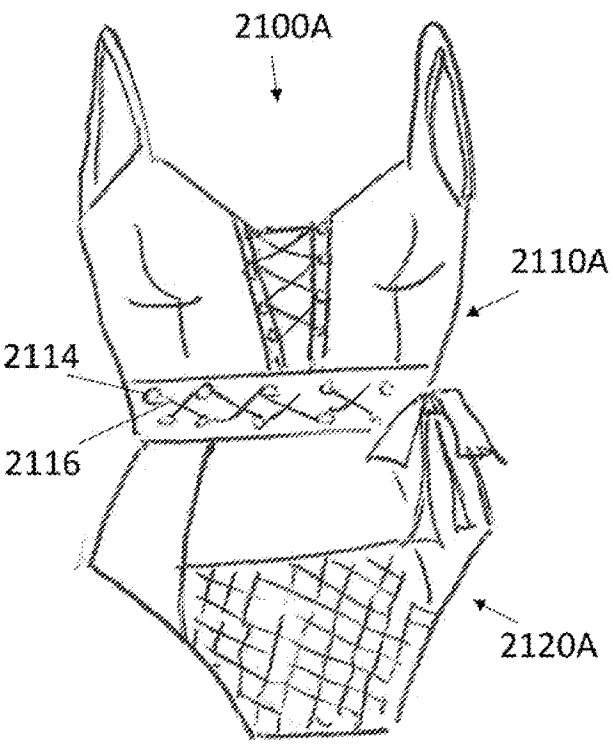
FIG. 21D
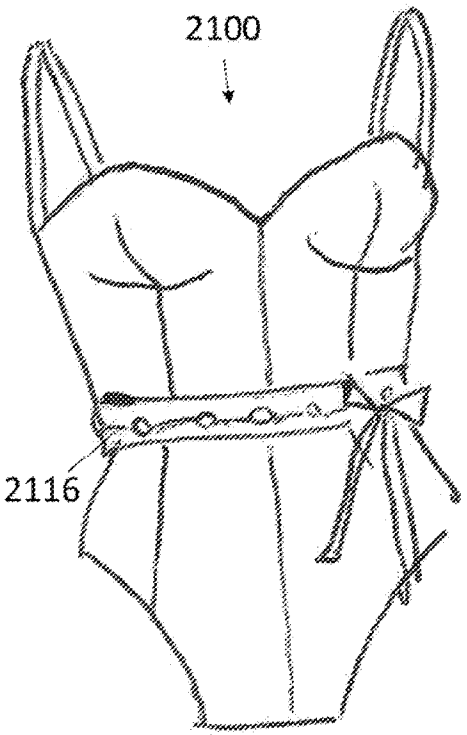
FIG. 21C
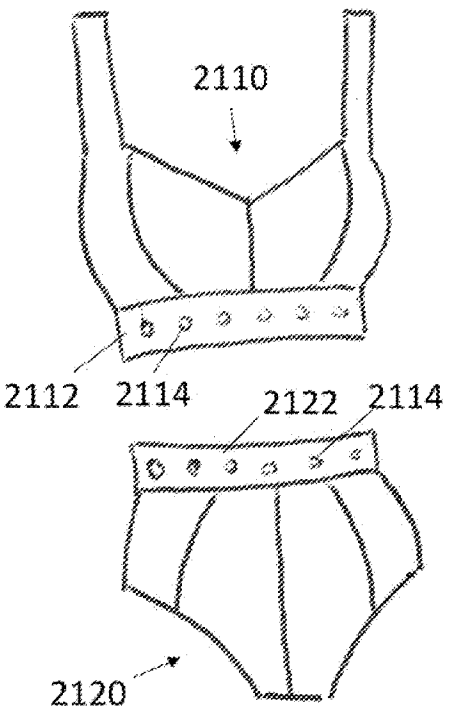
FIG. 21A
FIG. 21B

GENITAL CONCEALING UNDERWEAR FOR TRANS FEMALE GENDER PRESENTATION

CROSS REFERENCE TO RELATED APPLICATIONS

This application is a U.S. National Phase Patent Application of PCT Patent Application No. PCT/US2021/039867, filed Jun. 30, 2021, which is related to and claims priority from U.S. Provisional Application Ser. No. 63/045,964, titled UNDERWEAR DESIGN FOR GENITAL CONCEALMENT FOR TRANS FEMALE GENDER PRESENTATION, filed Jun. 30, 2020, the contents of each of which are incorporated herein by reference in their entireties for all purposes.

BACKGROUND OF THE INVENTION

Transgender ("trans") individuals have a gender identity that does not align with the sex identification assigned at birth. "Transgender" is an umbrella term that covers a diversity of gender identifications, including feminine males, masculine females, drag kings, drag queens, and transsexuals, who may acquire hormonal and surgical therapy to reassign their sex. However, not all transgender individuals choose reassignment surgical and/or medical treatments. Transgender individuals typically identify themselves according to their own sense of gender identity, rather than society's cultural normative expectations. Studies have shown that if an individual's biological sex aligns with his/her gender identity, that individual will have positive psychosocial engagement with others. If, however, these concepts are not aligned, then the individual is at risk for negative psychosocial engagement.

Historically, mainstream apparel companies have not designed products explicitly for transgender community, under the assumption that this community represents a small or niche market. This attitude is changing.

Gender expression has a strong association with fashion. The inventors conducted a study to develop a collection of underwear for individuals identifying as trans female by evaluating specific needs related to gender presentation. One object of designing the collection was satisfy the target population's apparel needs related to what the inventors have characterized as the 5F Framework™—fashion, fabric, fit, function, and fastener.

The inventors interviewed participants each identifying as trans female to identify the depth and breadth of preferences and needs for undergarments for AMAB (Assigned Male at Birth). The interviews confirmed a desire in the art for underwear designed specifically for AMAB transgender individuals.

SUMMARY OF THE INVENTION

Aspects of the invention relate to garments for concealing male genitalia of a wearer, each garment comprising a compressible region configured to be disposed over the genitalia of the wearer, and means for adjusting tensile forces exerted on the compressible region, wherein those tensile forces resolve to compression forces exerted by the compressible region on the wearer's genitalia.

Embodiments include a garment comprising a primary portion having a front region configured to lie adjacent a front body portion of the wearer and a back region configured to lie adjacent a back body portion of the wearer, and a connector portion configured to connect the front portion to the back portion. The connector has an adjustable length between a connection to the front portion and connection to the back portion, such that the means for adjusting the tensile forces comprises the adjustable length.

In some embodiments, the connector portion is attachable and detachable from the primary portion and comprises a first fastener portion of a front fastener interface on a front end and a first fastener portion of a back fastener interface on a back end. The primary portion comprises a second fastener portion of the front fastener interface disposed in the front region and a second fastener portion of the back fastener interface disposed in the back region. Each first fastener portion is configured to mate with each corresponding second fastener portion.

In some embodiments, the front portion of the primary portion has a first design element (e.g. the face of an animal) and a region of the connector portion comprises a second design element (e.g. the tongue of the animal). The first and second elements interact with one another to form a completed design having a variable presentation dependent upon the position of the front end of the connector.

In other embodiments, the connector portion has a fixed end attached to the primary portion and at least one free end that is attachable and detachable to the primary portion. In some such embodiments, the at least one free end of the connector portion may have a first fastener portion of a fastener interface and the primary portion may have a second fastener portion of the fastener interface. Embodiments may include one or more guides disposed in the back of the primary portion and configured to receive and guide the at least one free end of the connector portion to a fastener at a front of the garment. In some embodiments, the connector is bifurcated into a first tie having a first free end and a second tie having a second free end. The ties may be tied together in a knot, or each may have one mating portion of an adjustable fastener interface, for securing a desired degree of tension.

Exemplary garments may consists of bottoms only, or may comprise a bottom portion and a top portion, including embodiments in which the bottom portion and the top portion are separate and joinable, or in which the bottom portion and the top portion are unitary.

In some embodiments, the primary portion comprises a bottom portion and a top portion that form a unitary element and the connector portion has a fixed end attached to the primary portion and at least one free end that is attachable and detachable to the primary portion. In embodiments, the connector portion may be bifurcated into a first strap having a first free end with a first fastener portion of a first fastener interface and a second strap having a second free end with a first fastener portion of a second fastener interface. The top portion includes a first shoulder strap having the second fastener portion of the first fastener interface and a second shoulder strap having the second fastener portion of the second fastener interface.

In other embodiments, the connector portion is bifurcated into a first strap having a first free end and a second strap having a second free end, wherein the connector portion is configured to be disposed between the wearer's legs and adjacent a portion of the wearer's back, with the first strap and the second strap wrapped from back to front and secured to one another in the front in a waist region of the user. The primary portion may have one or more guides for guiding the first strap and the second strap from a bottom back of the primary portion to the waist region. Exemplary guides may include a first slit for receiving the connector portion adjacent a bottom back of the wearer and a second and third slits in the waist region of the user adjacent opposite sides of the back of the user for respectively receiving the first strap and the second strap. Or, a first slit may receive the connector portion adjacent a bottom back center of the wearer and a second slit in the waist region of the user adjacent a center of the back of the user may receive both the first strap and the second strap.

For some embodiments, another aspect of the invention includes a garment system, in which a primary portion component includes an embodiment having a unitary top and bottom, and the connector portion is attached to the primary portion, and another component includes underwear bottoms configured to be worn under the primary portion and the connector portion.

In another embodiment, the primary portion comprises a bottom portion and a top portion that form a unitary element and the connector portion is attachable and detachable from the primary portion. The garment comprises a fastener interface in each of a bottom region, a top region, and right side region, and a left side region, each fastener interface comprising a first portion on the primary portion and a second portion on the connector portion, wherein each first fastener portion is configured to mate with each corresponding second fastener portion.

In yet another embodiment, the garment comprises a separate top and a separate bottom, the top having a top portion of a fastener interface, the bottom having a bottom portion of a fastener interface. The fastener interface has a first configuration defining a first position of the top portion of the fastener interface relative to the bottom portion of the fastener interface, and a second configuration defining a second position of the top portion of the fastener interface relative to the bottom portion of the fastener interface. In this embodiment, the means for adjusting the tensile forces comprises the position of the top portion of the fastener interface relative to the bottom portion of the fastener interface. For example, the top and bottom portions of the fastener interface may each include a band comprising a plurality of openings for receiving a lacing strap, wherein the first configuration includes a first lacing technique and the second configuration includes a second lacing technique different from the first lacing technique.

In yet another embodiment, the garment comprises a top portion, a bottom portion, a front side, a back side, a pair of opposite side wings that each taper to a connected side strap, and a pair of shoulder straps. Each side wing is configured to wrap around a front of the user. At least one side wing has an opening for receiving the connected side strap, and the side straps configured to tie together to one another at a first variable location of the first strap and a second variable location of the second strap adjacent the front side. In this embodiment, the means for adjusting the tensile forces comprises selection of the first variable location and the second variable location.

Any of the garments as disclosed herein may include one or more padding pockets for receiving padding, and one or more pads configured to be disposed in the one or more pockets. In some embodiments, comprising one or more padding pockets for receiving padding, and one or more pads configured to be disposed in the one or more pockets, the means for adjusting the tensile forces consist of the one or more pads disposed in the one or more padding pockets, wherein selection of relatively greater thickness of the one or more pads results in relatively greater tensile forces. The one or more pads comprises a stitched or quilted fabric pad.

In another embodiment, the garment comprises a pair of flaps, each flap extending from a respective lateral side of the garment, the flaps configured to be secured in a closed configuration adjacent a front of the wearer, each flap comprising a mating portion of an adjustable fastener interface, wherein the means for adjusting comprises the adjustable fastener interface.

Garment embodiment may include at least one drawstring for adjusting at least one characteristic of the garment, such as waist circumference in some embodiments. In certain embodiments, the garment comprises an internal fabric catcher configured to be disposed over the wearer's genitalia, the catcher configured with a plurality of channels, including a channel on each lateral side, and a drawstring in each channel. The catcher is connected to an internal top front of the garment at one end, extends between the legs of the wearer, and is attached to an internal back top at an opposite end. Each drawstring has free ends extending outside the channels on opposite lateral sides of respective leg holes in the garment. A drawstring closure is located proximal of each drawstring end, wherein the means for adjusting the tensile force comprises a location of drawstring closure relative to the free ends of the drawstrings.

BRIEF DESCRIPTION OF THE DRAWINGS

FIG. 9A depicts a front side view of another undergarment having fabric stitched padding.

FIG. 9B depicts the back side of the undergarment of FIG. 9A.

FIG. 10A depicts a front side view of an undergarment having lace design features and an oval compression area.

FIG. 10B depicts the back side of the undergarment of FIG. 10A.

FIG. 21A depicts the front external side of a top portion of an exemplary customizable two-piece top/bottom bodysuit garment shown in isolation.

FIG. 21B depicts the front external side of the bottom portion of the exemplary two-piece top/bottom bodysuit garment of FIG. 21A shown in isolation.

FIG. 21C depicts the front of the two-piece bodysuit of FIGS. 21A-21B in an assembled configuration with an overlapping band lacing technique.

FIG. 21D depicts the front side of an another two-piece top/bottom bodysuit in an assembled configuration with a criss-cross lacing technique.

DETAILED DESCRIPTION OF THE INVENTION

Referring now to the figures, there are depicted a plurality of exemplary undergarment designs. The embodiments shown are only examples, and the functional aspects of the invention are not limited to the cut of the examples shown. Thus, each example depicted may be cut in any style known in the art, such as boy shorts, briefs, and bikinis, provided the design provides sufficient fabric to hold (i.e. "tuck") the genitals of the wearer, when the wearer wants to de-emphasize their presentation.

In general, aspects of the invention relate to garments for concealing male genitalia of a wearer, each garment comprising a compressible region configured to be disposed over the genitalia of the wearer, and means for adjusting tensile forces exerted on the compressible region, wherein those tensile forces dictate compression forces exerted by the compressible region on the wearer's genitalia.

Fully Attachable and Detachable Connector Portions

Some embodiments include a garment comprising a primary portion having a front region configured to lie adjacent a front body portion of the wearer and a back region configured to lie adjacent a back body portion of the wearer, and a connector portion configured to connect the front portion to the back portion, the connector having an adjustable length between a connection to the front portion and connection to the back portion, wherein the means for adjusting the tensile forces comprises the adjustable length.

In some embodiments, the connector portion is attachable and detachable from the primary portion and comprises a first fastener portion of a front fastener interface on a front end and a first fastener portion of a back fastener interface on a back end, and the primary portion comprises a second fastener portion of the front fastener interface disposed in the front region and a second fastener portion of the back fastener interface disposed in the back region, wherein each first fastener portion is configured to mate with each corresponding second fastener portion. Embodiments of this nature are depicted and discussed in more detail with respect to FIGS. 1A-1F through 4A-4B and 11A-11D.

Figure 2A:
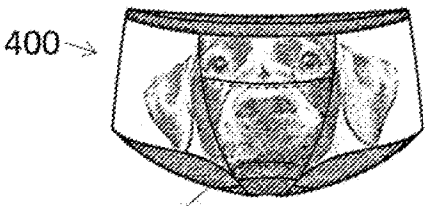
FIG. 2A depicts the front side of a primary portion of an unassembled two-piece undergarment having a variable design disposed thereon and having a front pocket for receiving a connector portion.
Figure 2B:
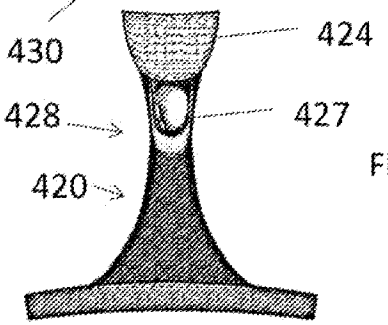
FIG. 2B depicts the exterior side of a connector portion of the unassembled undergarment for interfacing with the primary portion of FIG. 2A.
Figure 2C:
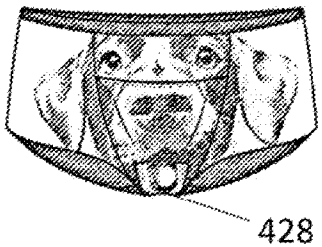
FIG. 2C depicts the components depicted in FIGS. 2A and 2B in one instance of an assembled configuration.
Figure 1A:
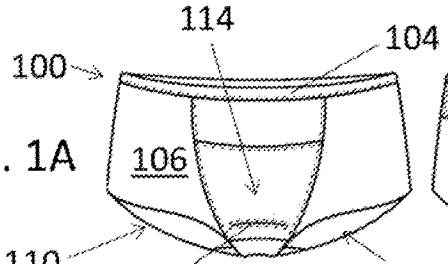
FIG. 1A depicts a front side view of a primary portion of an exemplary unassembled two-piece undergarment having a front pocket for receiving a connector portion.
Figure 1B:
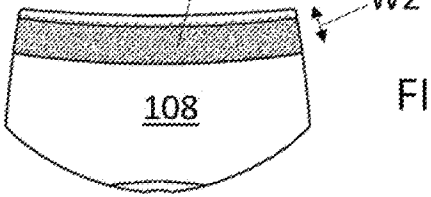
FIG. 1B depicts the back side of the primary portion of the unassembled undergarment of FIG. 1A.
Figure 1C:
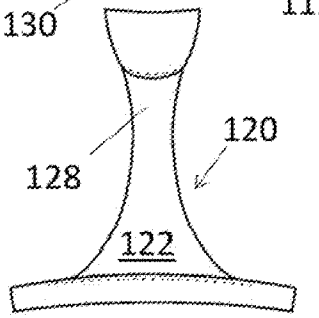
FIG. 1C depicts the exterior face of the unassembled connector portion of the undergarment of FIG. 1A.
Figure 1D:
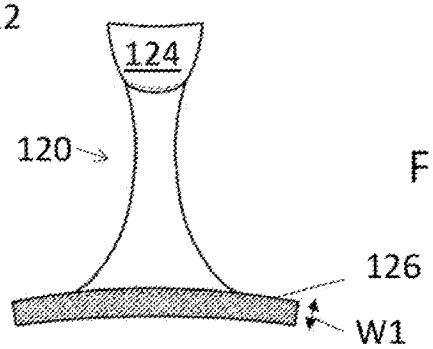
FIG. 1D depicts the interior face of the unassembled connector portion of the undergarment of FIG. 1A.
Figure 1E:
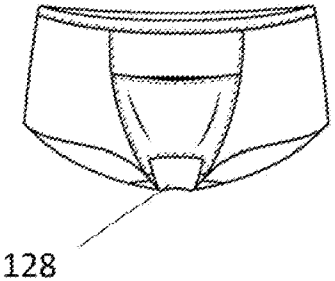
FIG. 1E depicts the front side exterior of the assembled undergarment of FIGS. 1A-1D.
Figure 1F:
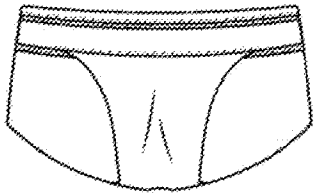
FIG. 1F depicts the back side exterior of the assembled undergarment of FIG. 1E.
Figure 4A:
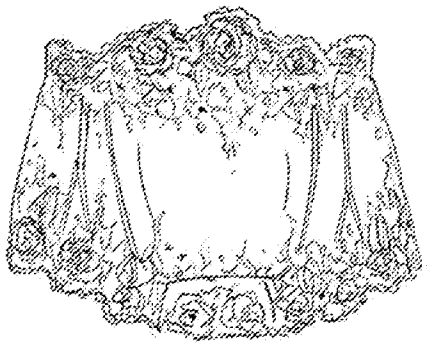
FIG. 4A depicts the front side of the assembled undergarment of FIGS. 3A-3D.
Figure 4B:
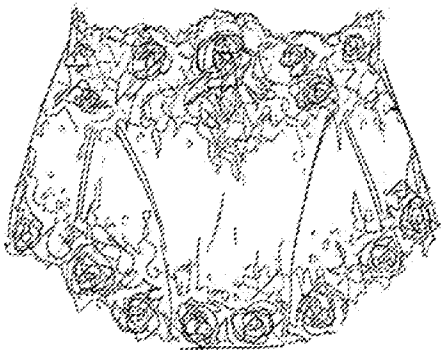
FIG. 4B depicts the back side of the assembled undergarment of FIG. 4A.
Figure 3B:
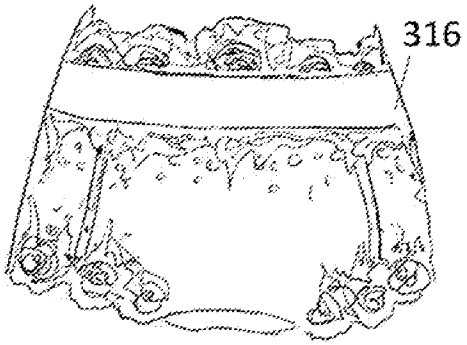
FIG. 3B depicts the back side of the primary portion of the unassembled undergarment of FIG. 3A.
Figure 3D:
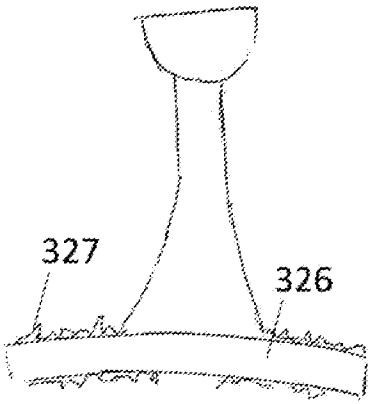
FIG. 3D depicts the interior face of the unassembled connector portion of the undergarment of FIG. 3A.
Figure 3A:
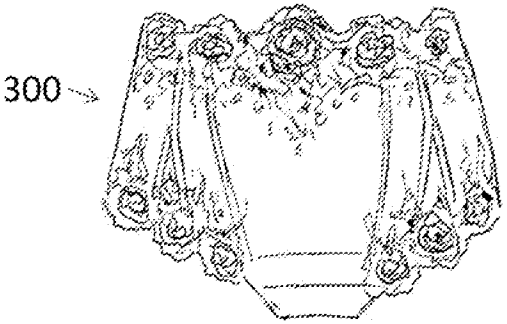
FIG. 3A depicts a front side view of a primary portion of another exemplary unassembled two-piece undergarment having a front pocket for receiving a connector portion.
Figure 3C:
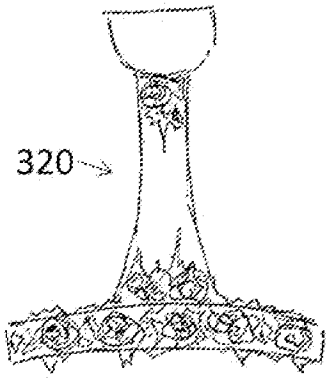
FIG. 3C depicts the exterior face of the unassembled connector portion of the undergarment of FIG. 3A.
Figure 5C:
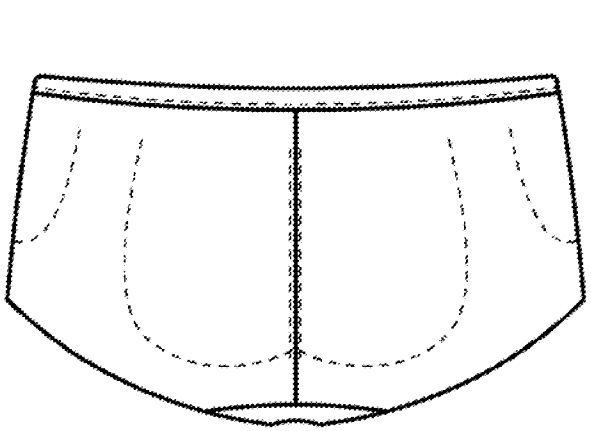
FIG. 5C depicts a back external view of the exemplary bottom of FIG. 5A.
Figure 5A:
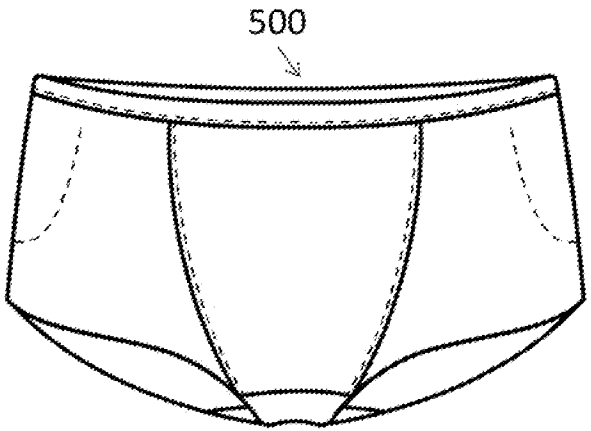
FIG. 5A depicts a front external view of an exemplary bottom showing exemplary padding locations.
Figure 5D:
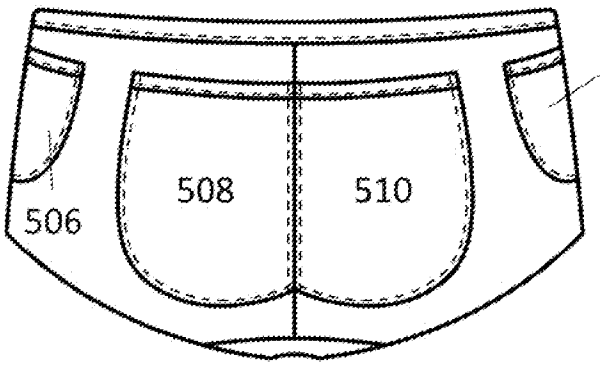
FIG. 5D depicts a back internal view of the exemplary bottom of FIG. 5C.
Figure 5B:
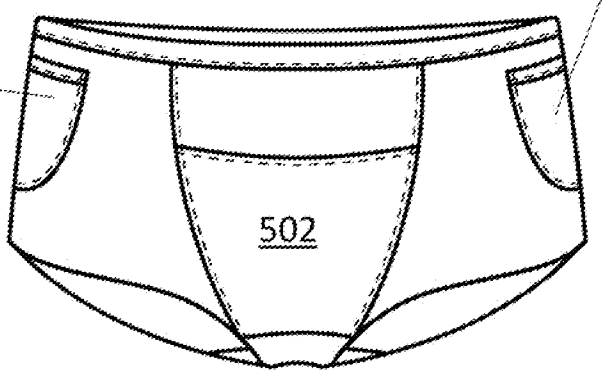
FIG. 5B depicts a front internal view of an exemplary bottom of FIG. 5A.

FIGS. 1A-1F and 2A-2C depict exemplary two-part underwear bottom configurations. FIGS. 1A-1D and 2A-2B depict unassembled configurations, and FIGS. 1E, 1F, and 2C depict assembled configurations. Referring now to FIGS. 1A-1F, bottoms 100 comprising a primary portion 102 comprising a waistband 104, a front face 106, a back face 108, and leg openings 110, 112. A connector portion 120, the exterior of which is depicted in FIG. 1C and the interior of which is depicted in FIG. 1D, is configured to attach to and extend between the front and the back of the primary portion, and defines the crotch 122 of the garment. Connector front fastener end 124 attaches to primary portion 102 in front fastener receiving area 114 and connector back attachment end 126 attaches to back attachment-receiving area 116. The fastener interface in the front (and/or back) are configured to permit attachment and detachment of the connector to the front (and/or back) of the garment in a plurality of different positions to provide a variable length in the crotch region. Thus, as shown the width W1 of portion 126 may be smaller than width W2 of portion 116.

Figure 11D:
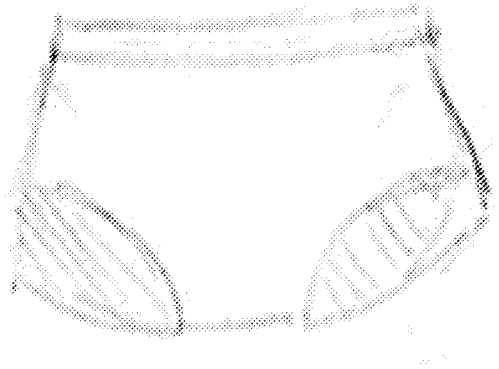
FIG. 11D depicts the front side exterior view of the primary portion of the exemplary unassembled two-piece undergarment of FIGS. 11A-C.
Figure 11C:
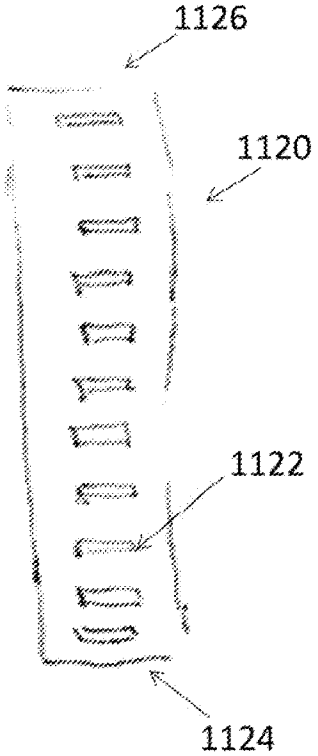
FIG. 11C depicts an exemplary unassembled connector portion for connection to the primary portion of the two-piece undergarment of FIGS. 11A and 11B.
Figure 11A:
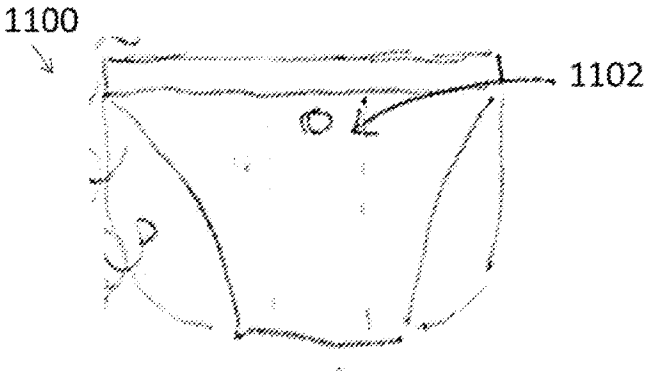
FIG. 11A depicts a front side interior view of a primary portion of an exemplary unassembled two-piece undergarment configured to receive a connector portion
Figure 11B:
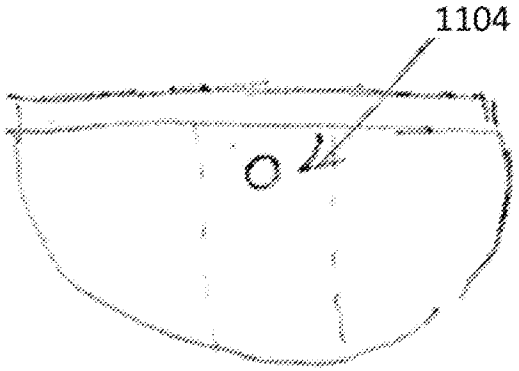
FIG. 11B depicts the back side interior view of the primary portion of the exemplary unassembled two-piece undergarment of FIG. 11A.

The fastener interfaces (114/124 and 116/126) may comprise hook and loop fasteners, such as VELCRO® brand microhook/microloop fasteners, in which the connector comprises a patch of microloops and the primary portion of the garment comprises a plurality of microhooks, or vice versa. In another embodiment, the fastener interface may comprise relatively larger hooks and eyes (not shown), such as for example are traditionally known in the art for connecting opposite ends of the an adjustable bra. In still another embodiment, for example, as depicted in FIGS. 11A-D, the fastener interface may comprise a plurality of buttonholes configured to receive one or more buttons in the connector. Thus, bottoms 1100 shown in FIGS. 11A-D, may have a fixed front button 1102 and a fixed back button 1104 on the interior faces of the undergarment, and connector 1120 may have a plurality of buttonholes 1122 in at least a front region adjacent a front end 1124 of the connector and a back region adjacent a back end 1126 of the connector, and the buttonholes may, optionally, be distributed along the entire length of the connector, as depicted. The primary portion of the bottoms may include a crotch portion, such that the connector provides the adjustability on the interior of the garment, as a liner, without the connector being visible from the outside of the garment, as depicted in FIG. 11D.

In preferred embodiments, the fastener interface may be provided in an external pocket (a pocket that opens to the outside of the garment), in which access opening (e.g. akin to a button hole) 130 in the pocket, for receiving the front end of the connector, faces downward to receive the connector. The access opening 130 may have a width that is equivalent to the width of neck 128 of connector 120, with the front end 124 of the connector having a width greater than the width of the opening, and the connector tapering from the front end toward neck, such that the bulbous front end of the connector is held in the pocket by the difference in widths. The front end of the connector and/or the external flap of the pocket may comprise padding or otherwise may be configured to soften or eliminate visible outlines of the fastener interface. The front end of the connector is secured to the front side of the primary portion of the garment and the rear of the connector is then attached to the back side of the primary portion. The connector preferably comprises an elastic fabric such that the wearer may adjust the tension of the compression by changing the elevation of the connection to the front end.

Embodiments of the invention may be configured with a design disposed on the primary portion (e.g. the face of an animal, such as the dog face shown in FIG. 4A on primary portion 400) that includes a variable design element 427 (e.g. the tongue shown in FIG. 2B) disposed on the neck 428 of connector 420, such that the position of the front end of the connector defines one of a plurality of possible design variations for the garment as a whole. For example, in the design shown in FIGS. 2A-2C, the closer to the waistband 402 that the front end of the connector 424 is inserted into the opening 430 in the pocket, the shorter the tongue of the dog (e.g. the lesser amount of neck 428) visible from the outside of the garment.

Although depicted in a simple form in FIGS. 1A-1F, embodiments of the two-piece bottoms may comprise any number of ornamental features, such as lace or other patterns. For example, as depicted in FIGS. 3A-4B, lace features 327 extend beyond the back fastener area 326 of connector 320 to cover portions of the back fastener area 316 of primary portion 300 that would otherwise be visible from the back exterior of the garment.

While embodiments of the invention may comprise any material known in the art, preferred embodiments may comprise modal cotton as a base fabric. The embodiment depicted in FIGS. 3A-4B may have stretch lace trim and overlay. Embodiments may include beading and embellishments, as well as faux boning and style lines, to conceal the two-piece design. Strips may be made from thicker, but stretchy trim. Lace may be configured to drape off the panty line slightly to conceal the elongated shape of garment.

Padding

Any of the garments as disclosed herein may include one or more padding pockets for receiving padding, and one or more pads configured to be disposed in the one or more pockets. In some embodiments, comprising one or more padding pockets for receiving padding, and one or more pads configured to be disposed in the one or more pockets, the means for adjusting the tensile forces consist of the one or more pads disposed in the one or more padding pockets, wherein selection of relatively greater thickness of the one or more pads results in relatively greater tensile forces. The one or more pads may comprise foam or may be stitched or quilted. Embodiments featuring padding will be discussed in more detail in connection with FIGS. 5A-5D through 10A-10B.

The bottoms 500 depicted in FIGS. 5A-5D includes five pockets: a front pocket 502, side pockets 504, 506, and back pockets 508, 510. In contrast to prior art products with sewn-in, fixed padding, the embodiment depicted in FIGS. 5A-5D provides the wearer with the opportunity to trim the sizes and shapes of the paddings (typically foam) based on their specific needs. The pockets may be sewn in the outer or inner side of the underwear, with pockets on the inner side minimizing presenting the shape of pockets, which may otherwise show in a manner akin to panty lines when consumers wear thin pants.

Figure 6A:
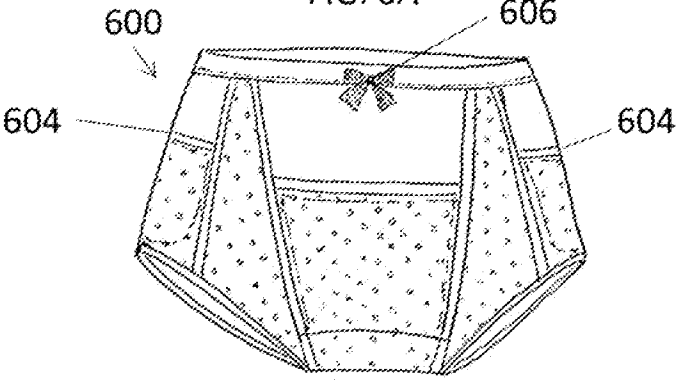
FIG. 6A depicts a front side view of an undergarment having quilted features.
Figure 6B:
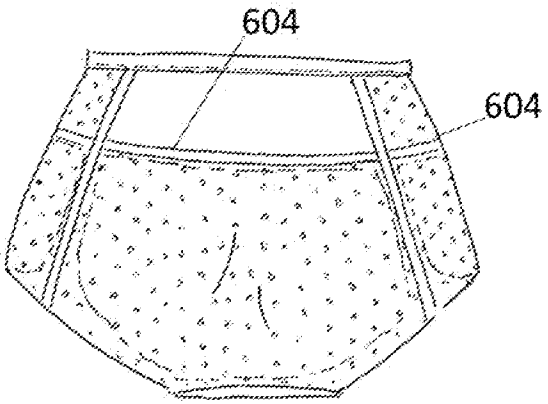
FIG. 6B depicts the back side of the undergarment of FIG. 6A.

Various features may be provided to conceal the pocket openings. For example, as depicted in FIGS. 6A-6B, an undergarment 600 having a modal cotton base fabric may comprise a stretch lace polka dot overlay, with faux boning and style lines 602 added to conceal pocket openings, with strips made from thicker, but stretchy trim. Various ornamental features may be added, such as a small satin box, 604.

Figure 7A:
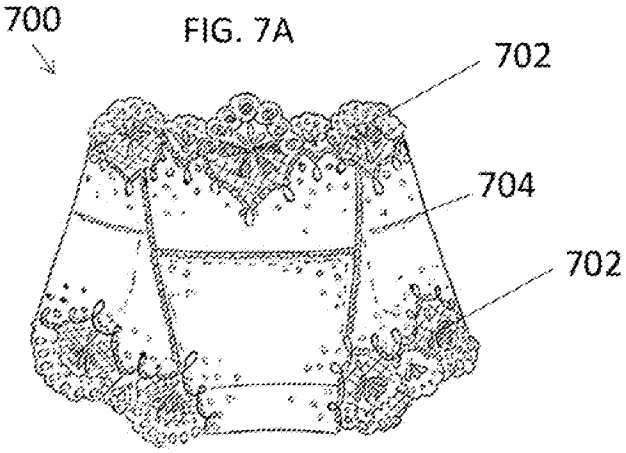
FIG. 7A depicts a front side view of an undergarment having lace design features.
Figure 7B:
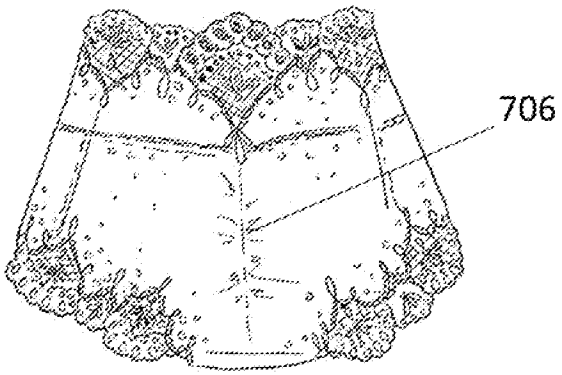
FIG. 7B depicts the back side of the undergarment of FIG. 7A.

In the embodiment depicted in FIGS. 7A-7B, bottoms 700 comprise a modal cotton base fabric outfitted with stretch lace trim 702 and overlay on the top and bottom, with beading and embellishments added as desired. Faux boning and style lines 704 again conceal pocket openings, with the strips preferably made from relatively thicker, but relatively stretchy trim. The lace drapes off of the panty line slightly to conceal the elongated shape of the garment. Gathers 706 in the back center are configured to accentuate the wearer's curves.

Figure 8B:
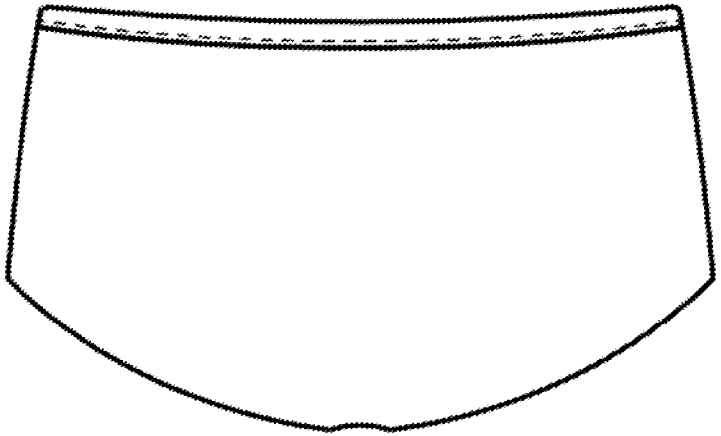
FIG. 8B depicts a back external view of the exemplary bottom of FIG. 8A.
Figure 8A:
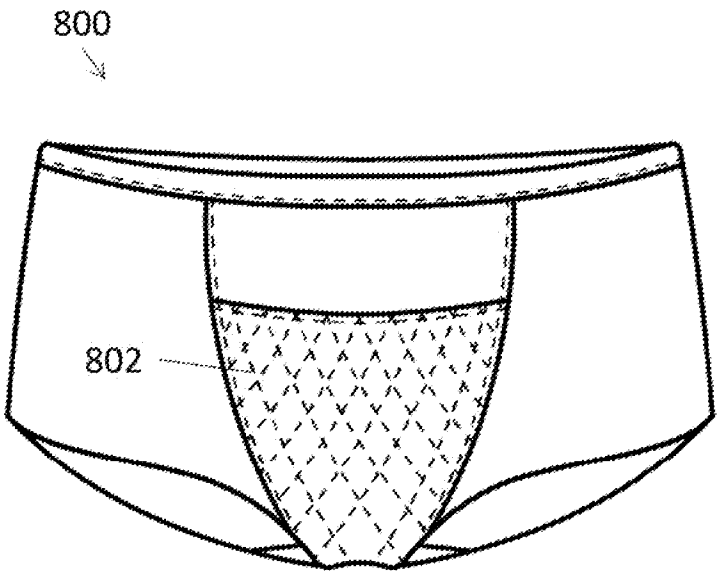
FIG. 8A depicts a front external view of an exemplary bottom showing exemplary fabric stitched padding.

In another embodiment, depicted in FIG. 8A-8B, garment 800 has fabric (rather than foam) padding to provide a different feelings of softness to the wearer. A plurality of stitches 802 on this fabric padding serves to strengthen the firmness of paddings and achieve better compression effects. Embodiments depicted in FIGS. 9A-9B and 10A-10B also depict compression embodiments, both of which may comprise a modal cotton base fabric outfitted faux boning and style lines to conceal pocket openings. In the embodiment depicted in FIGS. 9A-9B, to "blend" the appearance of the compression front piece, fabric 902 on the sides have a quilted look as a design element. The quilted fabric also has small beads on the intersections of each quilt square corner. Top stitch lines 904 on the top front of the garment add interest and further "blend" the functionality aspect of the garment.

In the embodiment depicted in FIGS. 10A-10B, the compression portion 1002 of bottoms 1000 has an oval shape with the pointed end of the oval adjacent the crotch 1004. The shape gives the appearance of French quilting. Lace 1006 drapes off the panty lines 1008 slightly to conceal the elongated shape of garment. Beading and embellishments may also be included.

The Boyfriend Short with Side Flaps

In another embodiment, the garment comprises a pair of flaps, each flap extending from a respective lateral side of the garment. The flaps are configured to be secured in a closed configuration adjacent a front of the wearer, each flap comprising a mating portion of an adjustable fastener interface, wherein the means for adjusting comprises the adjustable fastener interface. An example of this embodiment is discussed with respect to FIGS. 12A-12D.

Figure 12C:
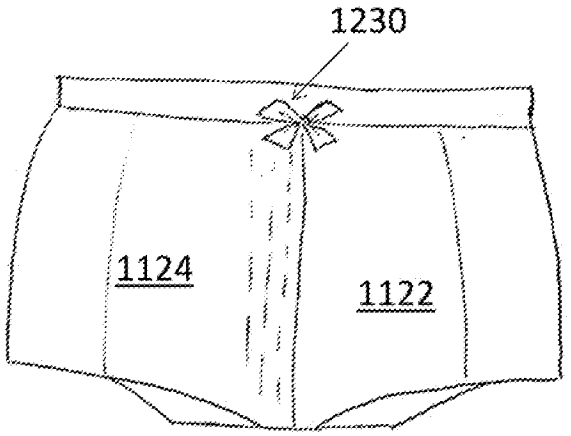
FIG. 12C depicts the front side of the undergarment of FIG. 12B with the side seam flaps partially closed.
Figure 12D:
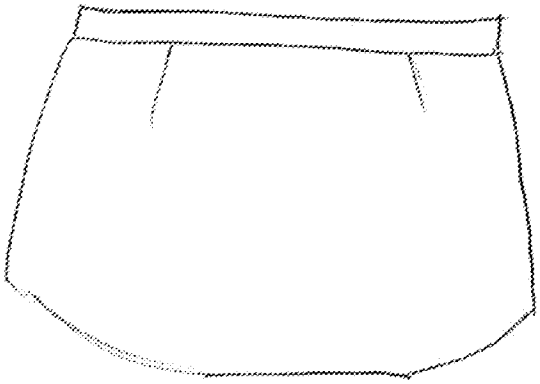
FIG. 12D depicts the back side of the undergarment of FIGS. 12A-12C.
Figure 12A:
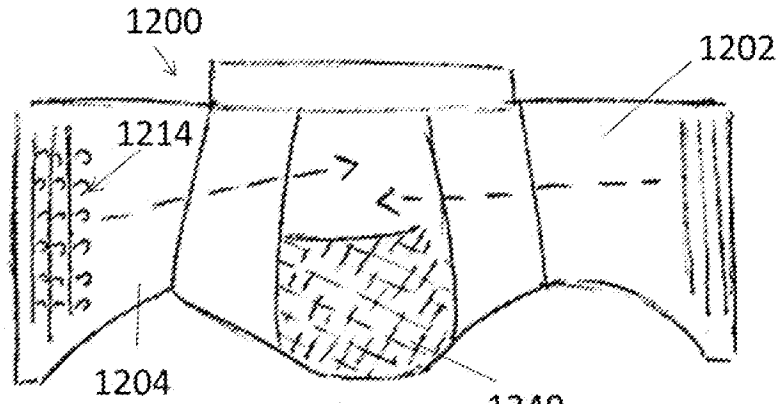
FIG. 12A depicts the front side of an exemplary undergarment showing opposite side seam flaps in an open configuration.
Figure 12B:
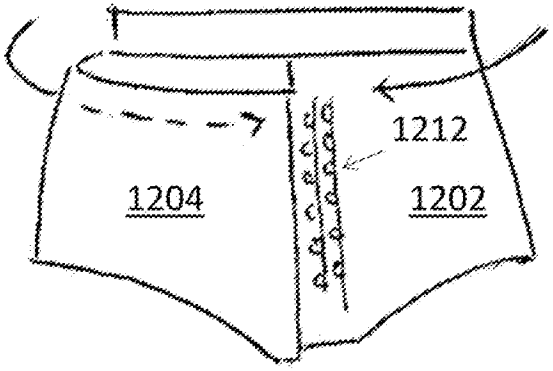
FIG. 12B depicts the front side of the undergarment of FIG. 12A with the side seam flaps partially closed.

The "boyfriend short" panty 1200 embodiment depicted in FIGS. 12A-12D includes a pair of open excess fabric side seam flaps 1202, 1204. The inner underwear is preferably constructed of typical comfortable undergarment materials. The bottom portion 1240 (depicted in cross-hatchings) is preferably constructed from highly compressive fabric in the same color as the rest of the garment. The fabric side seam "flaps" are preferably constructed from highly compressive stretch fabrics with rows of adjustable hook and eye closures to minimize the appearance of a genital bulge. The waistband of the underwear preferably comprises durable non-slip material to keep the garment in place. The compression fabric may act as the lining of the garment with a more aesthetically pleasing fashion fabric overtop. A wearer dons the undergarment by pulling the garment up to the wearer's waist with the wearer's legs in the leg holes, and then pulling the first flap 1202 to the front and the second flap 1204 over top, as depicted by the respective arrows in FIGS. 12A-12B. The wearer secures the flaps with hook and eye closures adjustable to specific compression needs. As depicted in FIGS. 12A-12B, hooks 1214 are shown on flap 1204 and eyes are depicted on flap 1202, but the placement may be reversed, and the fastener may comprise microhooks and microloops, or any type of adjustable fastener known in the art. Adornments, such as bow 1230, may be provided.

Drawstrings

Figure 24B:
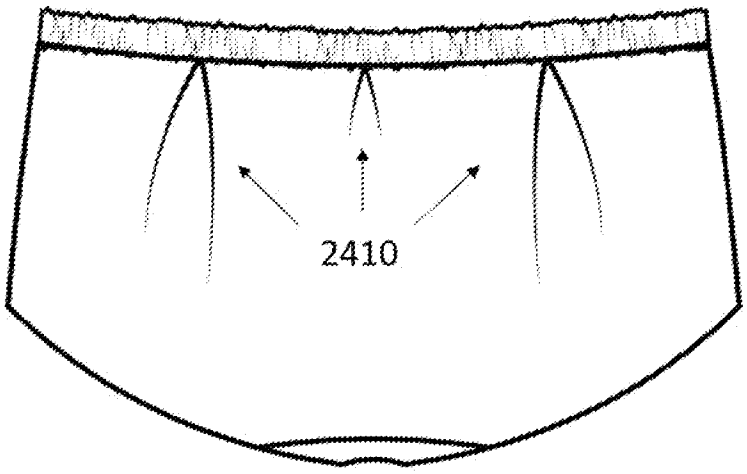
FIG. 24B depicts a back external view of the exemplary bottom of FIG. 24A.
Figure 24A:
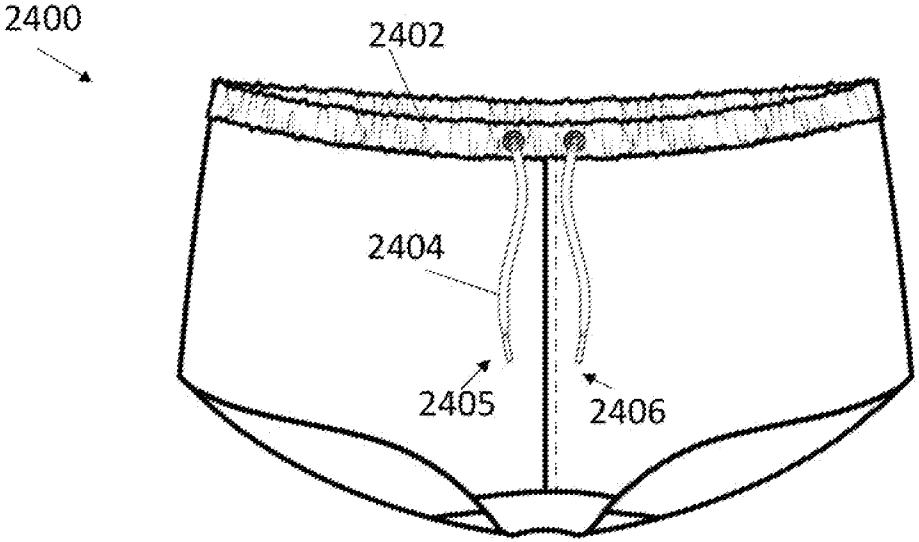
FIG. 24A depicts a front external view of an exemplary bottom showing exemplary fabric stitched padding having a drawstring adjustable waist.

Garment embodiments may include at least one drawstring for adjusting at least one characteristic of the garment. FIGS. 24A-24B, discussed below, depict a relatively traditional embodiment in which the adjusted characteristic is waist size. In other embodiments, the garment comprises an internal fabric catcher configured to be disposed over the wearer's genitalia, the catcher configured with a plurality of channels, including a channel on each lateral side, and a drawstring in each channel. The catcher is connected to an internal top front of the garment at one end, extends between the legs of the wearer, and is attached to an internal back top at an opposite end. Each drawstring has free ends extending outside the channels on opposite lateral sides of respective leg holes in the garment. A drawstring closure is located proximal of each drawstring end, wherein the means for adjusting the tensile force comprises a location of drawstring closure relative to the free ends of the drawstrings. This embodiment is discussed in more detail below with respect to FIGS. 13A-E.

In the embodiment depicted in FIGS. 24A and 24B, additional adjustability may be provided in the form of an adjustable waist size. Adding this feature may minimize consumers returning underwear purchased (e.g. online) without consumers trying them on. In the example depicted, the waist band 2402 includes a drawstring 2404 extending through a channel in the garment that permits the wearer to adjust waist size by pulling and tying the opposite ends 2405, 2406 of the drawstring in a position that provides the desired degree of compression against the wearer's torso. This design also features pleats 2410 to adapt extension of the butt muscle. In view of the bulkiness of the drawstring, this design may be more suited to loungewear or lazy day underwear not worn underneath tight clothing. Any of the other embodiments as described herein may include drawstrings and/or pleats, if suitable, without limitation.

Figure 13C:
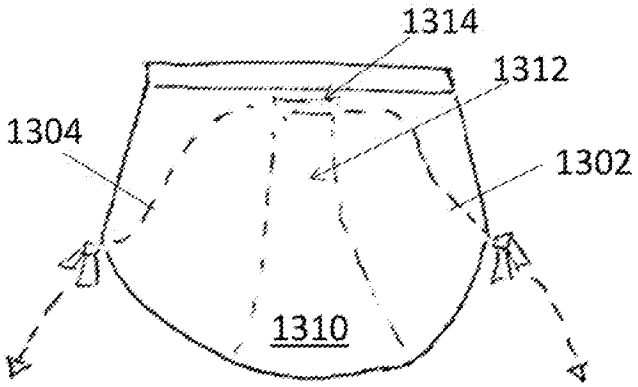
FIG. 13C depicts with dashed lines the locations of drawstrings within the undergarment of FIGS. 13A and 13B.
Figure 13A:
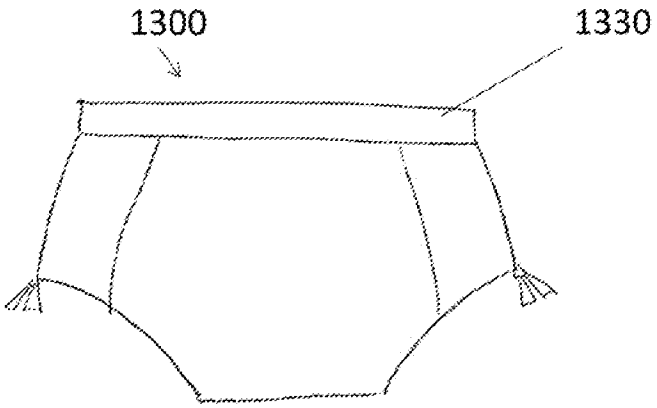
FIG. 13A depicts the front side of an exemplary undergarment comprising a plurality of drawstrings with ends that terminate on the lateral sides of the leg openings.
Figure 13B:
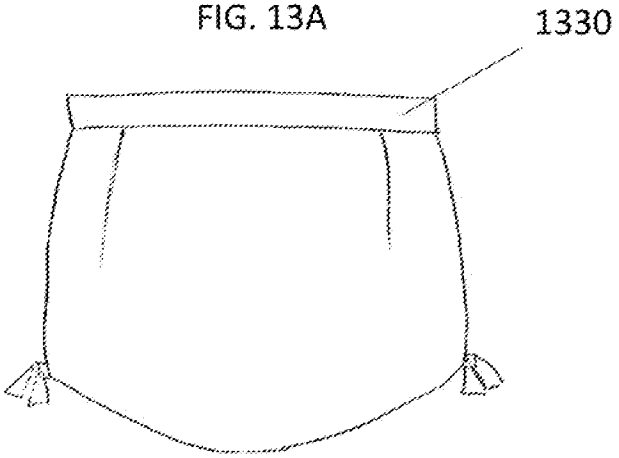
FIG. 13B depicts the back side of the exemplary undergarment of FIG. 13A.
Figure 13E:
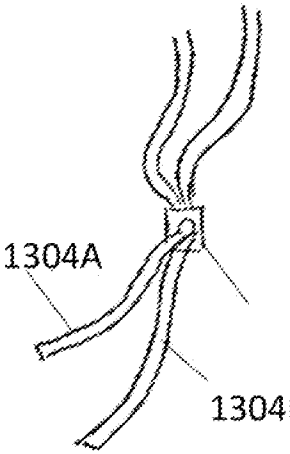
FIG. 13E is a magnified view of a closure for securing the drawstrings.
Figure 13F:
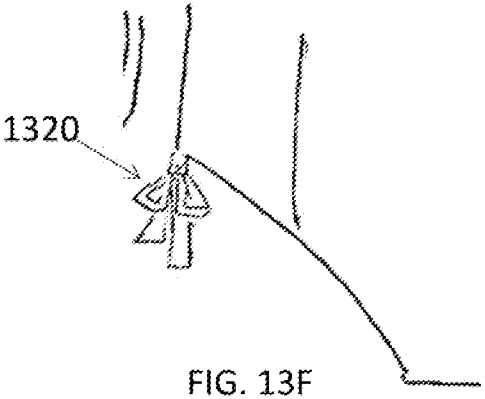
FIG. 13F is a magnified view of the lateral side of a leg opening.
Figure 13D:
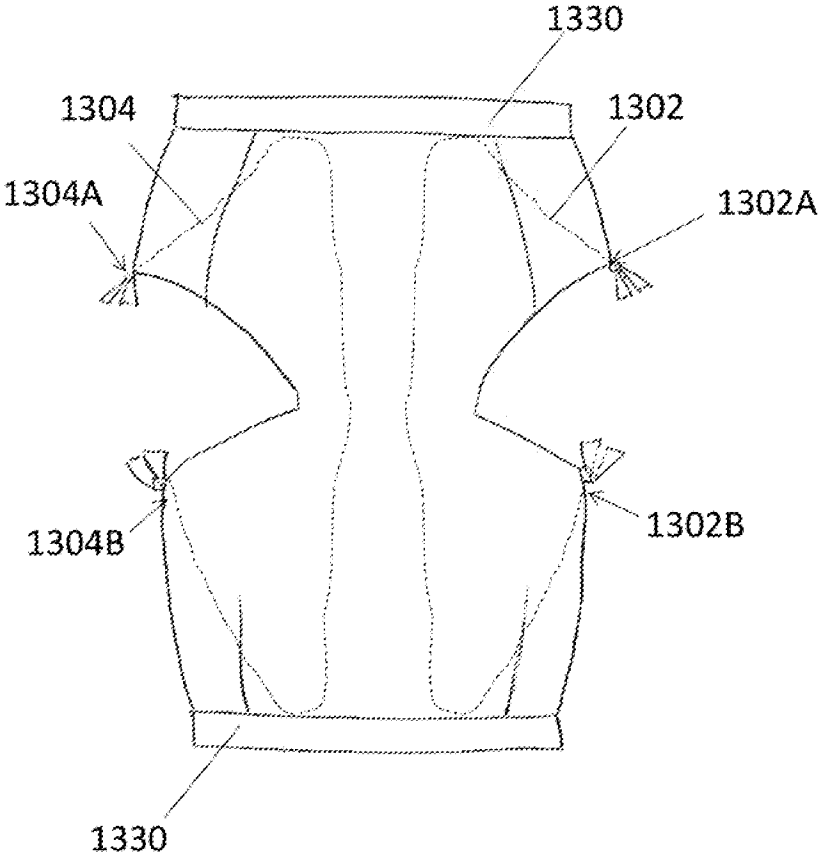
FIG. 13D depicts a cut and butterflied internal view, for illustration, of the exemplary undergarment of FIGS. 13A and 13B, depicting with dashed lines the locations of drawstrings.

The "high-waisted" design 1300 depicted in FIG. 13A-F include an internal fabric "catcher" 1310 that compresses the wearer's genitals dependent on how tight the drawstring 1302, 1304 straps are pulled by the wearer. FIGS. 13C and 13D depict in dashed lines the internal configuration of the drawstrings, which run through channels (not shown) in relation to the inner compression fabric catcher 1310. FIG. 14D depicts a "cut and butterflied" configuration in which the waistband 1330 has been severed to allow the view shown, for illustrative purposes only. The internal compression catcher 1310 has a generally rectangular front end 1312 with drawstring channels on the sides thereof. This rectangular front end 1312 of catcher 1310 is connected at the internal top front 1314 of the garment and extends medially along the legs of the wearer and up to the internal back top. The drawstrings 1302, 1304 extend out from the internal back compression band and travel internally through respective channels back down to the small openings on the lateral sides of the leg holes, where a small adjusting drawstring closure 1318 is used for keeping the wearer's desired compression secured to conceal the genitals. The exterior shell garment may be be constructed from comfortable and aesthetically pleasing fashion, while the interior strip of fabric may be constructed from highly compressive fabric to secure the genitals in place. Drawstring ends on the exterior of the garment may hang free or be knotted in a bow 1320 for an aesthetically pleasing appearance.

Connectors with One Fixed End and One Free End

In some embodiments, the connector portion has a fixed end attached to the primary portion and at least one free end that is attachable and detachable to the primary portion. The fixed end is typically sewn into the garment or an extension of the garment fabric, but any of the embodiments depicted herein may instead have a non-adjustable fastener interface at one end that essentially fixes that end, leaving only the free end for creating variable tension. In some embodiments, the at least one free end of the connector portion may have a first fastener portion of a fastener interface and the primary portion may have a second fastener portion of the fastener interface. Embodiments may include one or more guides disposed in the back of the primary portion and configured to receive and guide the at least one free end of the connector portion to a fastener at a front of the garment. In some embodiments, the connector is bifurcated into a first tie having a first free end and a second tie having a second free end, which ties may be configured to be tied together in a knot, or may each have one mating portion of an adjustable fastener interface. Exemplary garments may consists of bottoms only, or may comprise a bottom portion and a top portion, including embodiments in which the bottom portion and the top portion are separate and joinable, or in which the bottom portion and the top portion are unitary. Embodiments of this nature are discussed in more detail below with reference to specific figures.

Figure 14E:
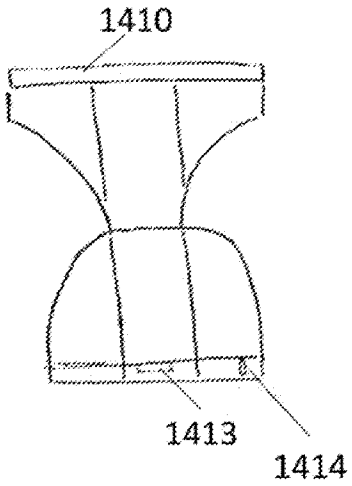
FIG. 14E depicts a cut and butterflied external view of the embodiment of FIGS. 14A-14D in an assembled configuration, for illustrative purposes, to show the position of the connector relative to the front and back faces of the garment.
Figure 14D:
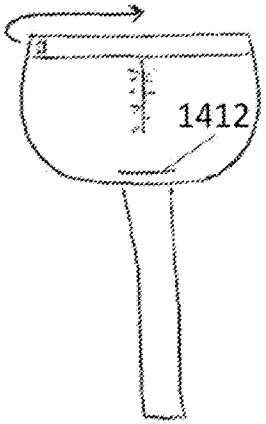
FIG. 14D depicts a back exterior view of the embodiment of FIGS. 14A and 14B in the unassembled configuration of FIG. 14C.
Figure 14C:
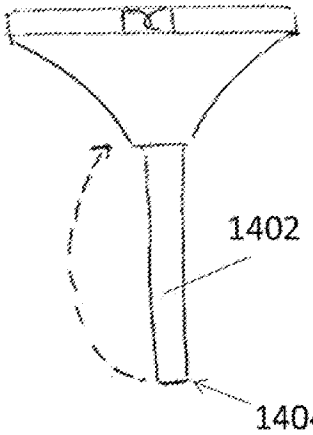
FIG. 14C depicts a front exterior view of the embodiment of FIGS. 14A and 14B in an unassembled configuration, showing the connector in an extended configuration.
Figure 14A:
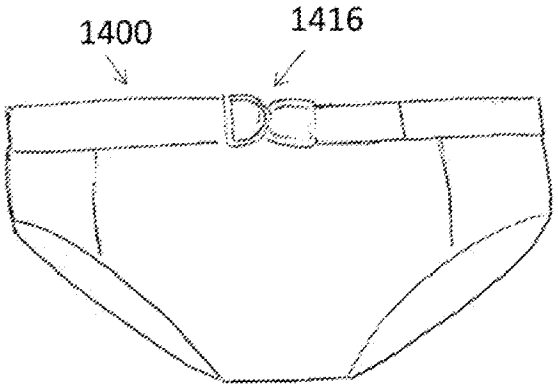
FIG. 14A depicts a front exterior plan view of an exemplary classic panty embodiment.
Figure 14B:
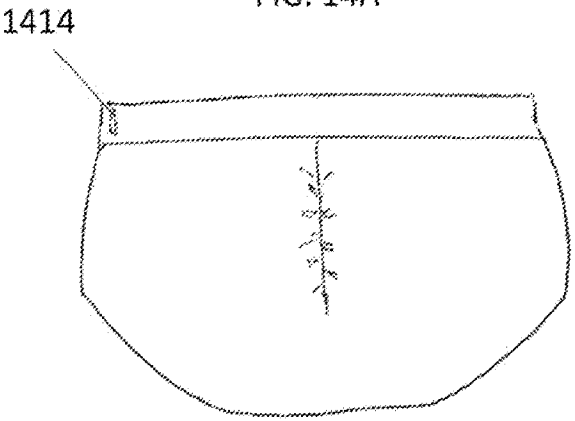
FIG. 14B depicts a rear exterior plan view of the exemplary classic panty embodiment.
Figure 15D:
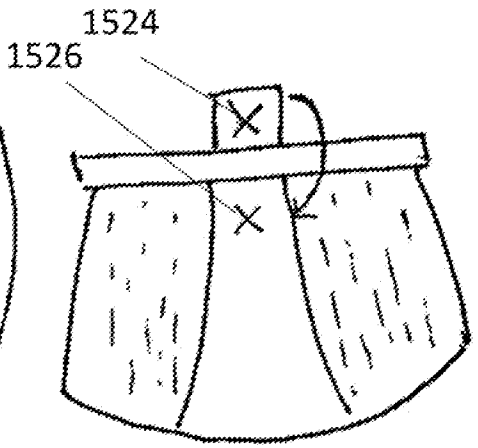
FIG. 15D depicts a front view of the undergarment of FIG. 15A, showing the adjustable connector flap in a nearly assembled position, prior to attachment of first and second connector portions.
Figure 15C:
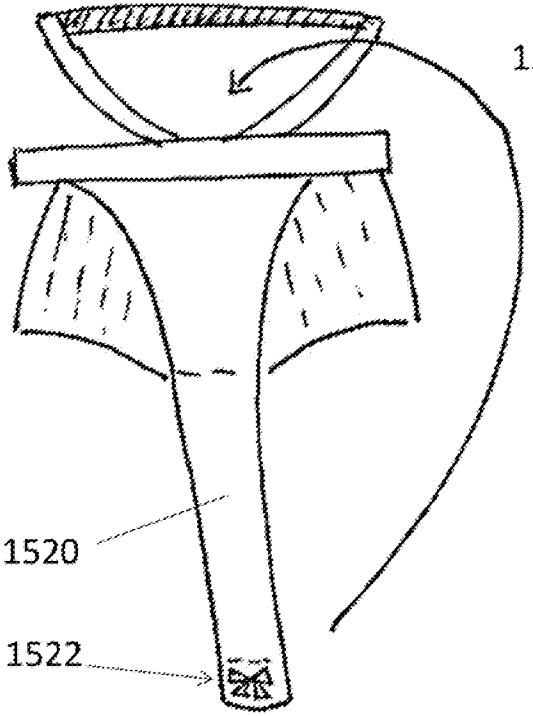
FIG. 15C depicts a front view of the undergarment of FIG. 15A, showing the adjustable connector flap in an extended position.
Figure 15A:
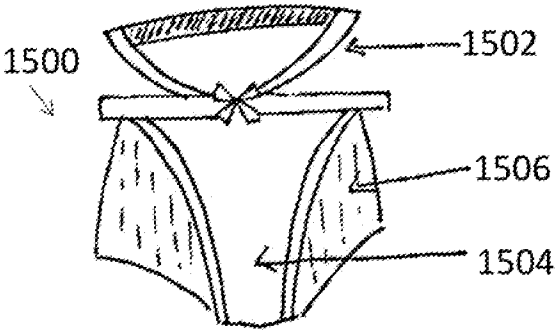
FIG. 15A depicts a front view of an exemplary thong-style undergarment in an assembled configuration.
Figure 15B:
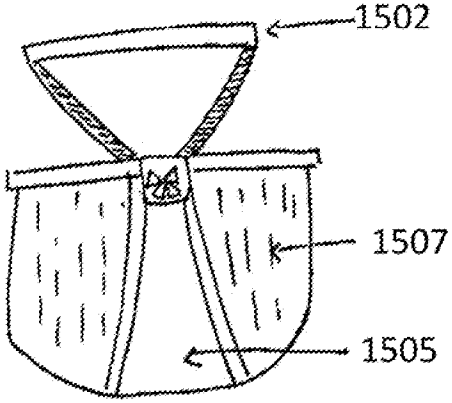
FIG. 15B depicts a back view of the undergarment of FIG. 15A in an unassembled configuration, showing the adjustable connector flap in a pre-assembly position.

A "classic" panty embodiment 1400 is depicted in FIGS. 14A-14E. The panty embodiment comprises an attached extended fabric connector piece 1402. The wearer dons the panty with extended fabric connector piece 1402 facing front. The wearer then moves the extended fabric piece backwards medially between the wearer's legs and inserts end 1404 of connector 1402 in entrance opening 1412 located in the center back bottom of the garment, and thread the connector via a channel to an exit opening 1413 in left back of the waistband. The wearer can then pull on end 1404 of connector 1402 toward the center front of the garment along the waist (e.g. through one or more belt loops 1414) to achieve a desired tightness and compression, and then secure the fabric through closure 1416 (depicted as a D-ring closure, but not limited to any particular type of closure). Notably, FIG. 14E depicts a "cut and butterflied" configuration in which the waistband 1410 has been severed to allow the view shown, for illustrative purposes only. Exemplary embodiments may be primarily constructed from comfortable and aesthetically pleasing fashion fabric on the front and back faces, while the extended fabric connector piece 1402 typically comprises highly compressive stretch fabric suitable to secure the genitals in place. The end portion 1404 that emerges from the waistband is preferably the same material/color fabric as the waistband. The waistband if preferably constructed from a highly durable/non-slip material to keep the garment in place.

A "thong" embodiment 1500 is depicted in FIGS. 15A-15D. The thong comprises a waistband 1502, a front fashion region 1504, rear thong fashion region 1505, front side wings 1506, rear side wings 1507, and an extended connector portion 1520. The free end 1522 of the extended connector portion comprises a distal fastener portion 1524 and a proximal fastener portion 1526. To don the garment, the wearer pulls up the compression panty with the extended connector portion 1520 in the front. The wearer then moves the extended connector portion 1520 between the wearer's legs and up the back side of the wearer, compressing the wearer's genitalia further in the motion. The wearer then threads the free end 1522 between the center back of the waistband 1502 and the wearer's waist, and then folds the free end back downward overtop of the waistband. The wearer can then adjust the tension on the connector portion to achieve a desired degree of genital compression and secure the distal 1524 and proximal 1526 fastener portions together to maintain the desired configuration. The interface between the distal and proximal fastener portions is preferably adjustable to enable different degrees of tension of the connector portion to achieve a preferred level of genital compression for the wearer. The front fashion region 1504 and rear fashion region 1505 generally present the geometry of a classic thong, and may have a first color, whereas the front side wings 1506 and back wide wings 1507 may comprise a sheer/skin colored compressive material for genital coverage. The shell of this embodiment may be constructed from highly compressive stretch materials. Decorative front side wings 1506 and back wide wings 1507 also may have stretch/compression characteristics to provide additional "security" and prevent against genital slippage. The waistband 1502 comprises highly compressive/non-slip materials.

Figure 16A:
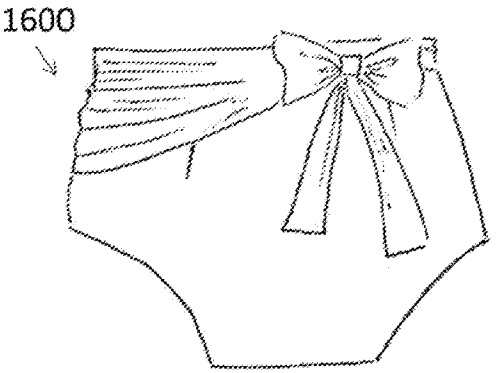
FIG. 16A depicts a front view of an exemplary undergarment in an assembled configuration.
Figure 16B:
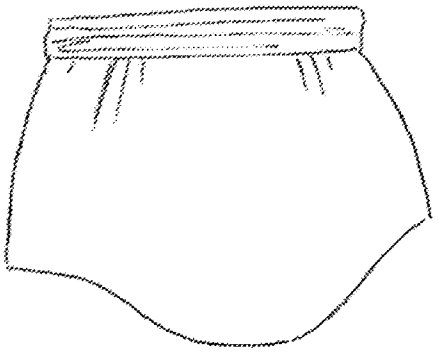
FIG. 16B depicts the back view of the exemplary undergarment of FIG. 16A in the assembled configuration.
Figure 16C:
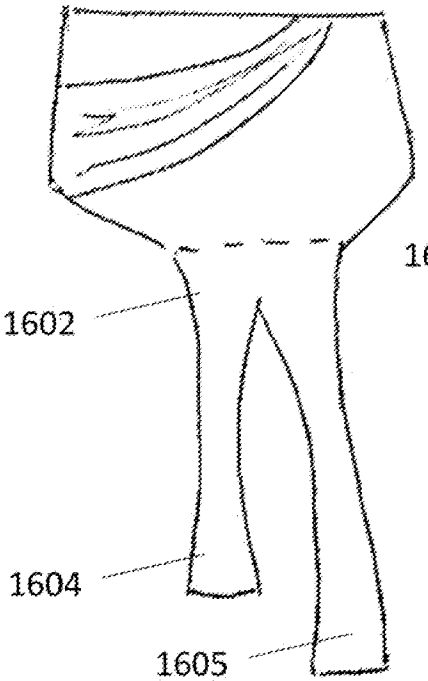
FIG. 16C depicts a front view of the exemplary undergarment of FIG. 16A showing an attached connector flap in an extended configuration.
Figure 16D:
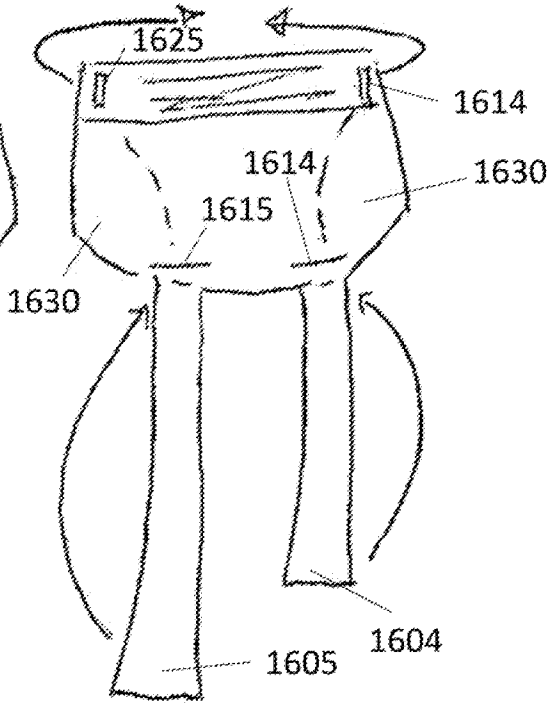
FIG. 16D depicts a back view of the exemplary undergarment of FIGS. 16A-16C showing the attached connector flaps in the extended configuration.
Figure 16E:
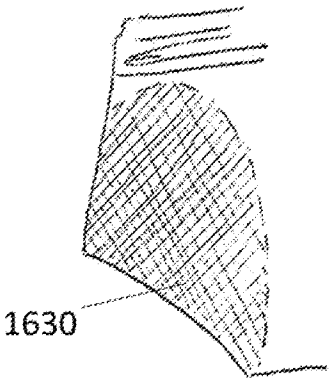
FIG. 16E depicts exemplary padding of the undergarment of FIGS. 16A-D.

A "tie bikini bottom" embodiment 1600 is depicted in FIGS. 16A-16E. Embodiment 1600 includes a bifurcated connector portion 1602 terminating in a pair of fabric ties 1604, 1605. A wearer dons the bikini bottom with the fabric ties 1605,1605 facing front. The wearer then moves the ties backwards between the wearer's legs, and inserts the ties into respective bottom back center opening holes 1614, 1615. The ties travel upwards through channels in the garment and exit the garment through respective side seam openings 1624, 1625. The user then pulls the ties forward, compressing the genitals through the motion, and secures the desired degree of compression with a decorative bow tied in the off center waistband front of the garment. To accommodate the off-center tie, one fabric tie is longer than the other. Although depicted with the wearer's left tie shorter than the wearer's right tie, the configuration may be reversed, and in other embodiments designed to have a centered bow, the lengths of the ties may be the same. The crosshatched region of FIG. 16E and the dashed lines in FIG. 16D depict the location of internal padding 1630 that may be provided to create the illusion of feminine hips and an hourglass silhouette. Embodiments may be constructed from typical bathing suit material, such as Lycra®. The draping detailing, as well as the tie portions of the connector may be constructed from contrasting or coordinated fabrics/colors for aesthetic purposes. Light padding may be added to the hip area to aid in the desired hourglass figure.

Bodysuits

In some embodiments, the primary portion comprises a bottom portion and a top portion that form a unitary element and the connector portion has a fixed end attached to the primary portion and at least one free end that is attachable and detachable to the primary portion. In some embodiments, the connector portion is fixed to one end and bifurcated into a first strap having a first free end and a second strap having a second free end. The free ends may have fasteners or may tie. One or more guides may be provided, e.g., for guiding the first strap and the second strap from a bottom back of the primary portion to the waist region. Exemplary guides may include slits, loops, or channels. In some bodysuit embodiments, the bodysuit is one element in a garment system that also includes underwear bottoms configured to be worn under the primary portion and the connector portion. Specific examples of the foregoing are discussed in more detail with reference to specific figures, below.

Figure 25A:
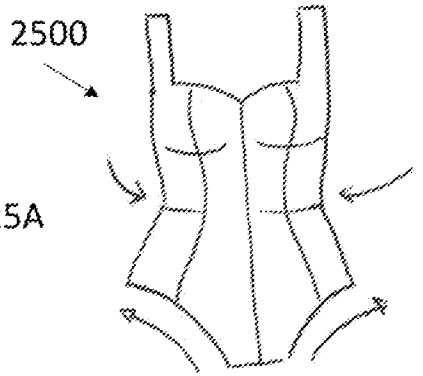
FIG. 25A depicts a front view of an exemplary bodysuit design showing desired forces for creating an hourglass figure.
Figure 25B:
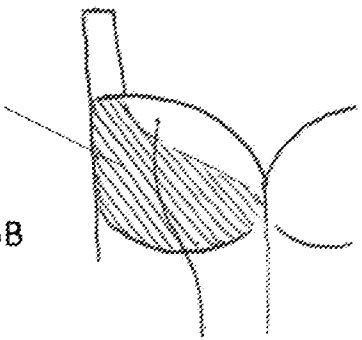
FIG. 25B depicts a front view of bra padding of the bodysuit of FIG. 25A.
Figure 25C:
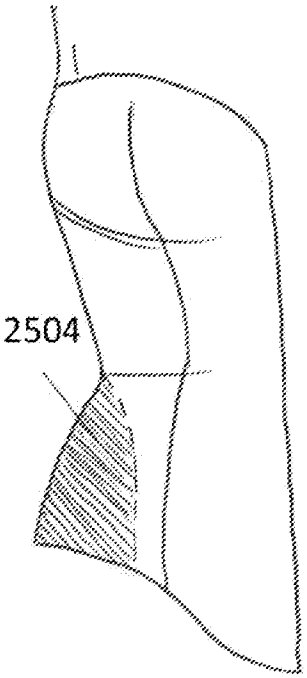
FIG. 25C depicts a side view of rear padding of the bodysuit of FIG. 25A.

FIGS. 25A-25C depict exemplary padding applicable to any of the bodysuit designs discussed herein. In general, exemplary bodysuit 2500 may comprise both chest padding 2502 and hip padding 2504 to simulate a feminine silhouette. FIG. 25A depicts the hourglass shape that the padding is intended to help achieve. FIG. 25B depicts exemplary internal placement of the chest padding 2502, whereas FIG. 25C depicts exemplary internal placement of the hip padding 2504.

Figure 17C:
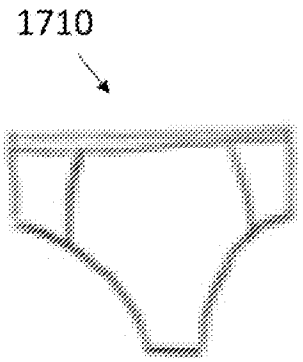
FIG. 17C depicts an exemplary underwear portion for use with the bodysuit portion of FIGS. 17A-17B (and other bodysuits as depicted herein).
Figure 17B:
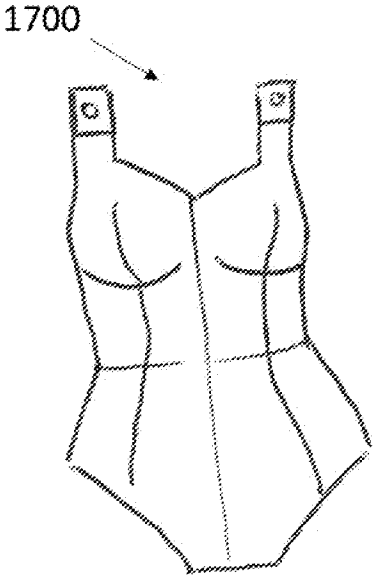
FIG. 17B depicts the front side of the bodysuit portion of FIG. 17A in an assembled configuration.
Figure 17A:
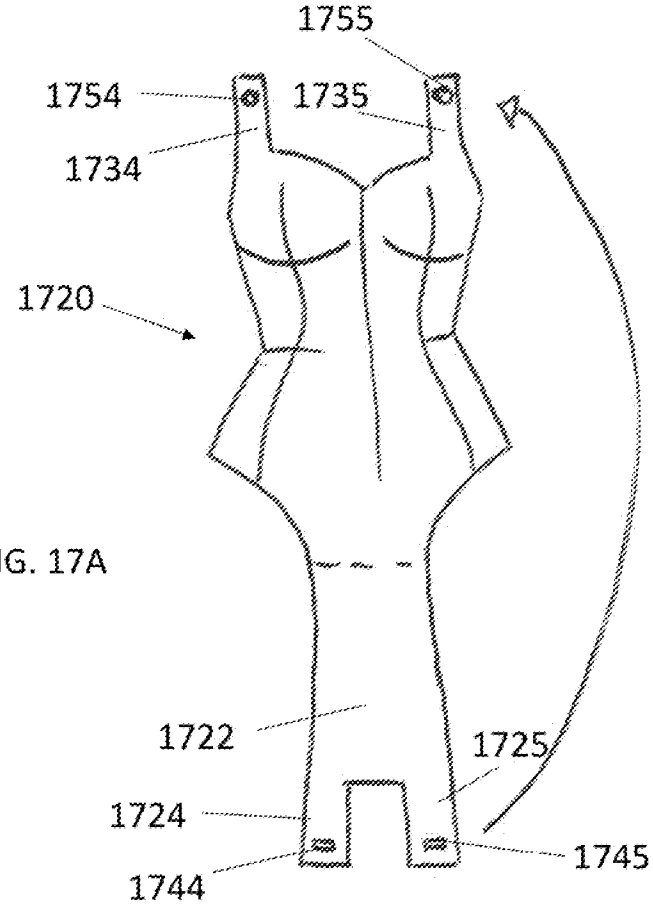
FIG. 17A depicts the front side of an exemplary bodysuit portion of a two-piece garment having an attached connector flap, shown in an extended, unassembled configuration.

FIGS. 17A and 17B depict a two-piece a bodysuit embodiment 1700 comprising an underwear portion 1710 and a bodysuit portion 1720 having an attached bifurcated connector 1722 terminating in left and right straps 1724, 1725. To don the garment, the wearer first dons the underwear portion 1710. The user then dons the bodysuit portion 1720 with the bifurcated connector facing front. The connector 1722 is disposed between the wearer's legs and stretched up the back of the wearer to create tension that compresses the wearer's genitals. The wearer then fastens the connector straps 1724 to the front top of the respective shoulder straps 1734, 1735. This motion will pull chest flesh upward and create the illusion of cleavage. As depicted in FIGS. 17A-B, connector straps 1724, 1725 have first respective fastener portions 1744, 1745 in the form of button holes, and shoulder straps 1734, 1735 have second respective fastener portions 1754, 1755 in the form of buttons, but the design is not limited to any particular type of fastener. The fastener may comprise multiple buttonholes or otherwise provide adjustability to allow the user to adjust the tension of the connector and resulting compression of the genitals. In embodiments, the majority of the bodysuit garment may be crafted from comfortable stretch fabric, which may include lace or modal cotton. Connector 1722 may be made from highly compressive stretch fabric for functionality purposes. The exterior of the connector may contain the same overlay material as the shell of the garment.

Figures 18A, 18B, 18C:
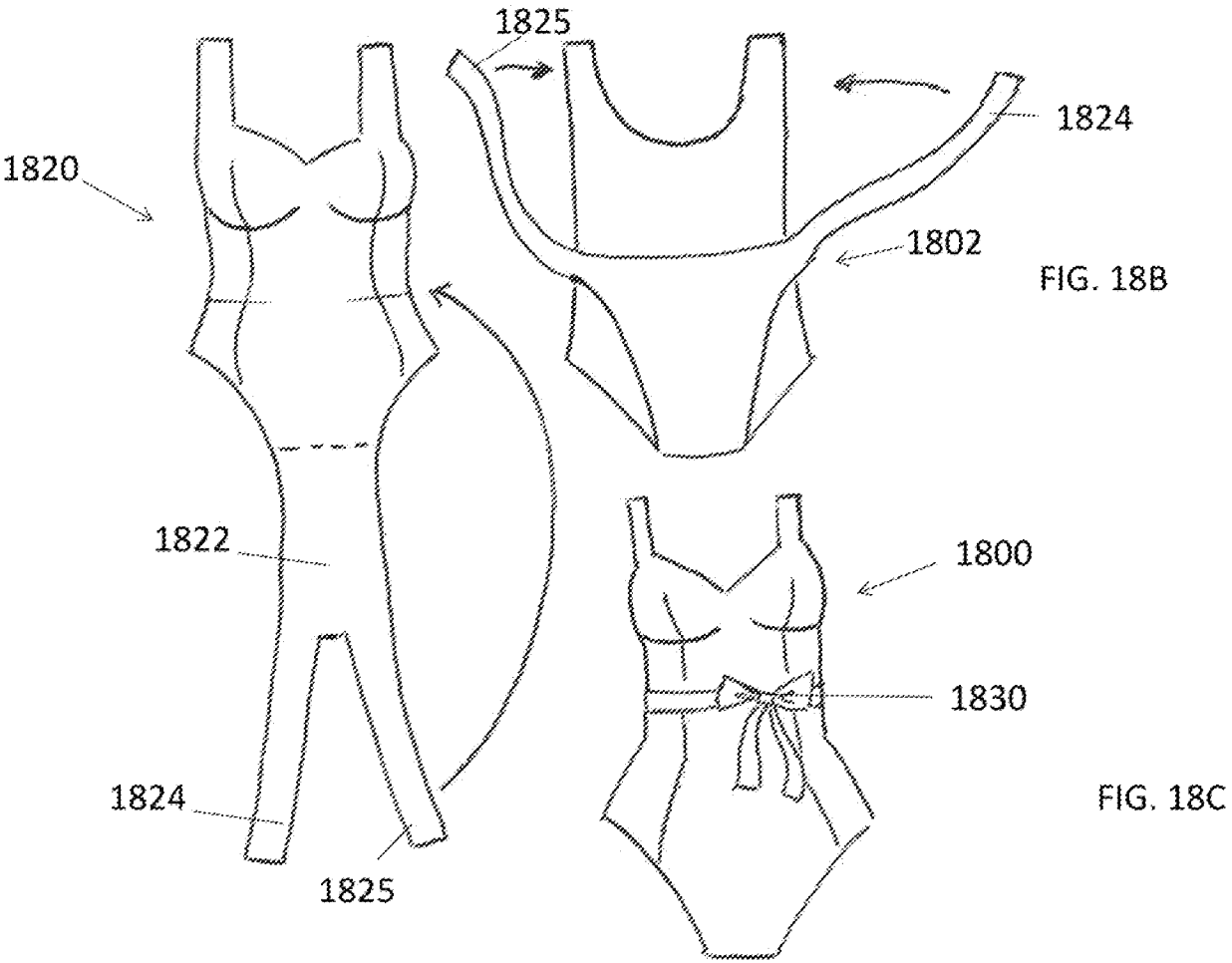
FIG. 18A depicts the front side of an exemplary one-piece bodysuit garment having an attached connector flap, shown in an extended, unassembled configuration.
FIG. 18B depicts the back side of the bodysuit garment of the garment of FIG. 18A in a pre-assembly configuration.
FIG. 18C depicts the front side of the exemplary one-piece bodysuit garment of FIGS. 18A and 18B in an assembled configuration.

FIGS. 18A-18C depict a two-piece exterior wrap bodysuit embodiment 1800, which includes a bodysuit portion 1820 and an underwear portion, such as underwear 1710 depicted in FIG. 17C, but which may be any type of underwear known in the art, typically having no special compression features. Bodysuit portion 1820 comprises a bifurcated connector 1822 that splits into two tie portions 1824, 1825. To don the bodysuit, the wearer first dons the underwear (e.g. 1710), and then dons the bodysuit over the underwear, with the connector 1822 disposed in the front. The wearer then moves the connector between the wearer's legs from front to back so that the connector extends up the wearer's back, stopping at the back waist 1802 and compressing the wearer's genitals in an upward direction. The wearer will then take the tie portions 1824, 1825 at the back waist and pull them toward the user's front at an elevation that provides a desired degree of compressibility. To secure the fabric, the user ties the ties in a knot (e.g. as a decorative bow 1830) in the front of body suit. The majority of the bodysuit garment is preferably crafted from comfortable stretch fabric, which may include lace or modal cotton. The connector 1822 may comprise highly compressive stretch fabric for best functionality. The external side of the connector may comprise a same overlay material as the shell of the garment. The tie portions may comprise a contrasting or coordinating fabric/color for aesthetic purposes.

Figure 19C:
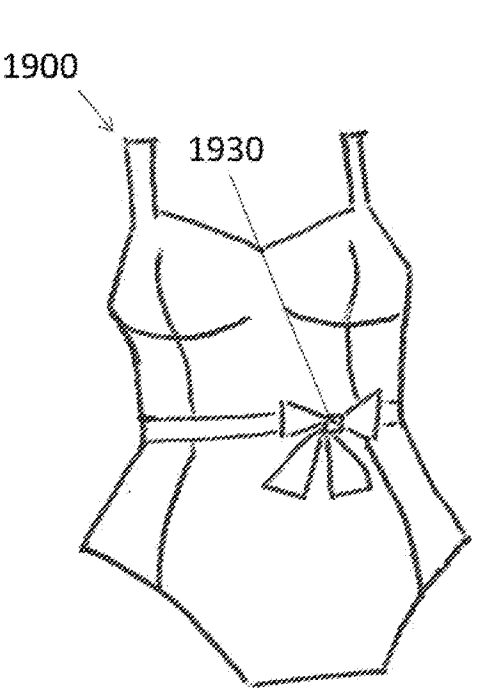
FIG. 19C depicts the front side of the exemplary one-piece bodysuit garment of FIGS. 18A and 18B in an assembled configuration.
Figure 19B:
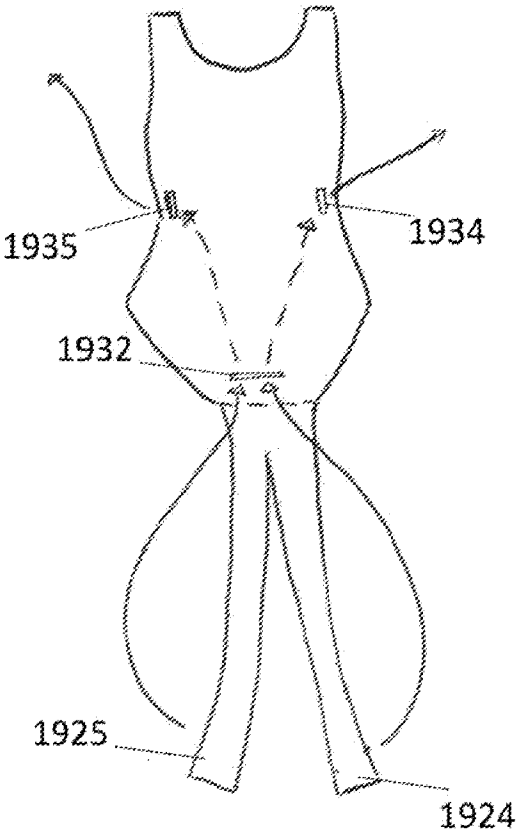
FIG. 19B depicts the back side of the bodysuit garment of the garment of FIG. 19A in showing holes for receiving the opposite.
Figure 19A:
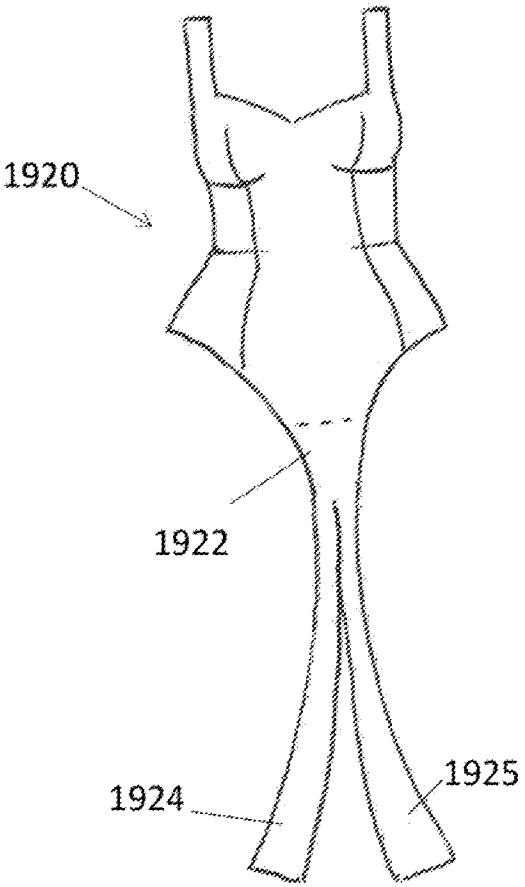
FIG. 19A depicts the front side of another exemplary one-piece bodysuit garment having an attached bifurcated connector flap, shown in an extended, unassembled configuration.

FIGS. 19A-19C depict a two-piece interior wrap bodysuit embodiment 1900, which includes a bodysuit portion 1920 and an underwear portion, such as underwear 1710 depicted in FIG. 17C, but which may be any type of underwear known in the art, typically having no special compression features. Bodysuit portion 1920 comprises a bifurcated connector 1922 that splits into two tie portions 1924, 1925. To don the bodysuit, the wearer first dons the underwear (e.g. 1710), and then dons the bodysuit over the underwear, with the connector 1922 disposed in the front. The wearer then moves the connector between the wearer's legs and threads the bifurcated connector 1922 through the opening 1932 at the bottom of the center back of the bodysuit, and continues moving the connector upwards as shown by the dashed arrows in FIG. 19B. The tie portions will exit the body suit through respective side seam slits 1934, 1935. As the connector is pulled forward from the side seam slits to the front of the bodysuit, the wearer's genitals are compressed, and a desired tightness is secured by tying the tie portions in a knot, such as a decorative bow. In embodiments, the majority of the bodysuit garment is crafted from comfortable stretch fabric, which may include lace or modal cotton. The connector preferably comprises highly compressive stretch fabric. The external face of the connector may comprise a same overlay material as the shell of the garment. The tie portions of the connector may comprise a contrasting or coordinating fabric/color for aesthetic purposes.

In some bodysuit embodiments, the primary portion may include a bottom portion and a top portion that form a unitary element and the connector portion is fully attachable and detachable from the primary portion. The garment comprises a fastener interface in each of a bottom region, a top region, and right side region, and a left side region, each fastener interface comprising a first portion on the primary portion and a second portion on the connector portion, wherein each first fastener portion is configured to mate with each corresponding second fastener portion. This embodiment is discussed in more detail below.

Figure 20E:
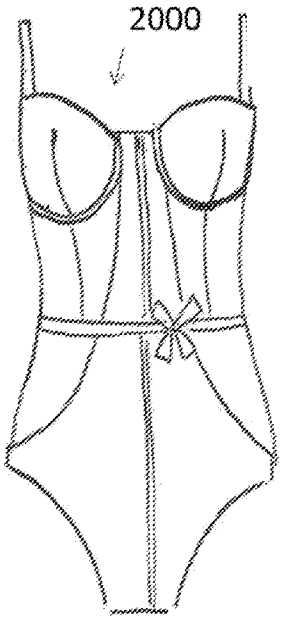
FIG. 20E depicts back side of the bodysuit garment of FIGS. 20A-20D in the assembled configuration.
Figure 20D:
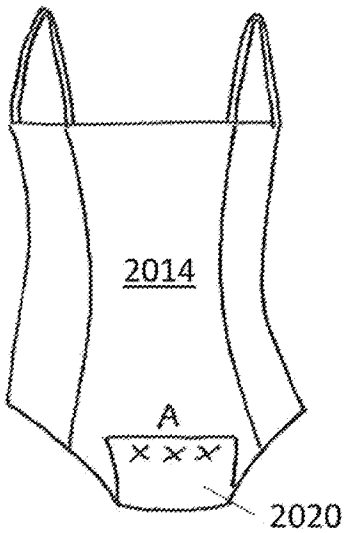
FIG. 20D depicts back side of the bodysuit garment of FIGS. 20A-20C in an assembled configuration.
Figure 20C:
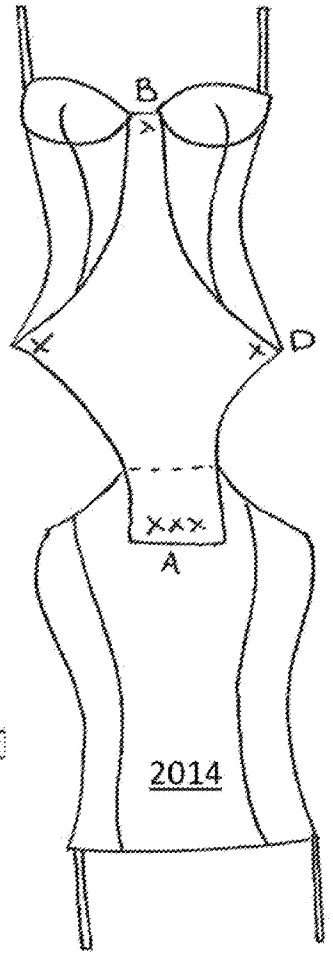
FIG. 20C depicts the exterior of the three-piece bodysuit garment of FIGS. 20A and 20B with the three pieces attached, in an extended configuration.
Figure 20B:
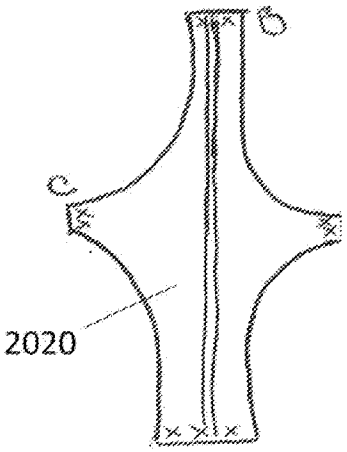
FIG. 20B depicts the front external side of a connector portion of the three-piece bodysuit garment shown in isolation.
Figure 20A:
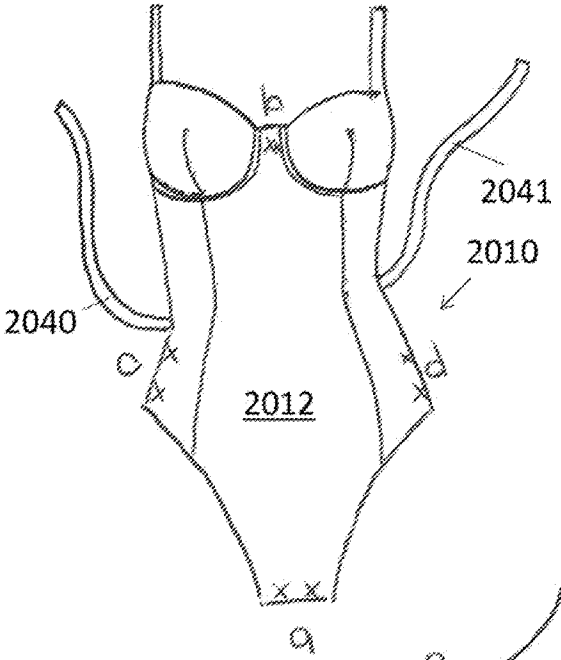
FIG. 20A depicts the front external side of the front primary portion of an exemplary three-piece bodysuit garment shown in an extended, unassembled configuration.

FIGS. 20A-20E depict a two-piece interior wrap bodysuit embodiment 2000. The bodysuit embodiment comprises a primary portion 2010 having a front 2012 and a back 2014, and a connector portion 2020 that connects to the primary portion at multiple fastener locations. Connector portion 2020 comprises four fastener interfaces A, B, C, and D that connect to mating respective fastener interfaces a, b, c, and d of primary portion 2010. In an exemplary embodiment, the fastener interfaces may comprise standard hook and eye closures, microhook/microloop closures, buttons and buttonholes, or combinations thereof, without any limitation to any particular type of fastener technology. In use, a wearer will don the bodysuit as shown in FIG. 20A and attach the fastener interfaces of connector portion 2020 to the mating fastener interfaces on primary portion 2010 (e.g. A mates with a, B mates with b, C mates with c, and D mates with d). The fastener interfaces are preferably adjustable to permit different positions or fastener configurations to set different degrees of tension of the fabric, resulting in different degrees of compression of the wearer's genitals. Connector 2020 comprises a compression overlay piece that extends slightly past the lower bottom area as shown in FIG. 20D. Once the four fastener interfaces are secured, ties 2040, 2041 attached to side seams of the primary bodysuit portion are brought to the front and tied in the front to accentuate the waist. The assembled bodysuit is depicted in FIG. 20E. Compression overlay assists the wearers in tucking genitals. In embodiments, the shell garment may comprise comfortable fashion fabric, which may be purely decorative, without functional properties. Connector 2020 may comprise a highly compressive stretch fabric with an added layer of fashion material on top to blend the appearance of the primary portion and the connector portion together. Ties may comprise contrasting and/or coordinating fabric for aesthetic purposes.

FIGS. 23A-23F depict a "plunge halter" one-piece embodiment 2300 that may be suitable for a bodysuit or swimwear. The bodysuit comprises a body portion 2310 and a bifurcated connector portion 2320 that forks into two ties 2322, 2323, with each free end 2324, 2325 of the respective ties having a respective portion 2326, 2327 of a mating fastener interface. To don embodiment 2300, the wearer will step into and pull up body portion 2310, leaving the bifurcated connector portion 2320 facing forward. The wearer then moves the connector portion 2320 from front to back between their legs and inserts the connector portion 2320 through the slit opening 2312 on the center bottom back of the garment body portion 2310. The fabric internally travels up the back of the garment, and the respective ties exit through center back opening 2314. The left tie 2323 will exit to the wearer's left, and the right tie 2322 will exit to the wearer's right from the slit. Tensioning connector portion 2320 up the back of the wearer compresses the wearer's genitals. The wearer will the take the remaining fabric of the ties and wrap them around from back to front. The user will secure the suit with the adjustable fastener (e.g. hooks and eyes, microloops/microhooks, buttons/buttonholes) at the extended fabric piece ends, essentially creating a belt using ties 2322, 2323. Hip padding 2340 may be added to give the wearer a desired silhouette, and chest padding 2342 may aid in presenting an illusion of breasts. In embodiments, garment 2300 may be created primarily from Lycra® or any other comfortable waterproof material (for a swimsuit embodiment). The connector 2320 preferably comprises highly compressive waterproof fabric to hold genitals in place as well as cinch the users waist.

Top and Bottom Separates

In yet another group of embodiments, the garment comprises a separate top and a separate bottom, the top having a top portion of a fastener interface, the bottom having a bottom portion of a fastener interface. The fastener interface has a first configuration defining a first position of the top portion of the fastener interface relative to the bottom portion of the fastener interface, and a second configuration defining a second position of the top portion of the fastener interface relative to the bottom portion of the fastener interface. In this embodiment, the means for adjusting the tensile forces comprises the position of the top portion of the fastener interface relative to the bottom portion of the fastener interface. For example, the top and bottom portions of the fastener interface may each include a band comprising a plurality of openings for receiving a lacing strap, wherein the first configuration includes a first lacing technique and the second configuration includes a second lacing technique different from the first lacing technique. An exemplary embodiment is discussed in more detail with respect to FIGS. 21A-21D.

FIGS. 21A-21D depict two-piece customizable bodysuit embodiments 2100, 2100A. This embodiment comprises a top portion 2110 having a first fastener interface 2112 and a bottom portion 2120 having a second fastener interface 2122. The fastener interfaces are used for connecting the top to the bottom portion in at least two different configurations, including a relatively closer configuration depicted in FIG. 21C and a relatively more distant configuration depicted in FIG. 21D. As depicted, each fastener interface 2112, 2122 comprises a band having a plurality of grommets 2114 for receiving a lacing strap 2116, wherein different lacing options provide the different configurations. In other embodiments, adjustability may be provided by using hook and eye closures, microhook/microloop fasteners, buttons and buttonholes, and the like, without limitation. In use, the wearer will don a top portion 2110 and a bottom portion 2120 specific to their compression needs and/or fashion interest. FIGS. 21A and 21B depict separated exemplary top and bottom undergarments, each comprising a grommet band 2112, 2122 as the respective first or second fastener interface. In the top, grommet band 2112 is placed under the bust line, and for the bottoms, grommet band 2122 is disposed as the waistband. FIG. 21C depicts an overlapping band lacing option for joining the top and bottom portions together, and FIG. 21D depicts a criss-cross lacing option. The overlapping band lacing option generally provides a tighter compression fit than the criss-cross lacing option, when applied to the same wearer. Notably, FIG. 21D also depicts a different top portion design 2110A and a different bottom portion design 2120A than the respective top and bottom portions 2110, 2120 depicted in FIG. 21C. The tops and bottoms may be constructed so that a wearer may mix and match tops and bottoms from a plurality of choices in any combination. So, for example, top 2110A may be paired with bottom 2120 or bottom 2120A and top 2010 may be paired with bottom 2120 or bottom 2120A. In embodiments, each top and bottom set may be made from their respective fabrics but may be crafted in similar color palates to blend together as one bodysuit seamlessly. The grommet bands may be constructed from highly compressive stretch fabrics to keep the pieces stabilized and flush against the body of the wearer.

The Stingray™

In some embodiments, the garment comprises a top portion, a bottom portion, a front side, a back side, a pair of opposite side wings that each taper to a connected side strap, and a pair of shoulder straps. Each side wing is configured to wrap around a front of the user. At least one side wing has an opening for receiving the connected side strap, and the side straps configured to tie together to one another at a first variable location of the first strap and a second variable location of the second strap adjacent the front side. In this embodiment, the means for adjusting the tensile forces comprises selection of the first variable location and the second variable location.

Figure 22B:
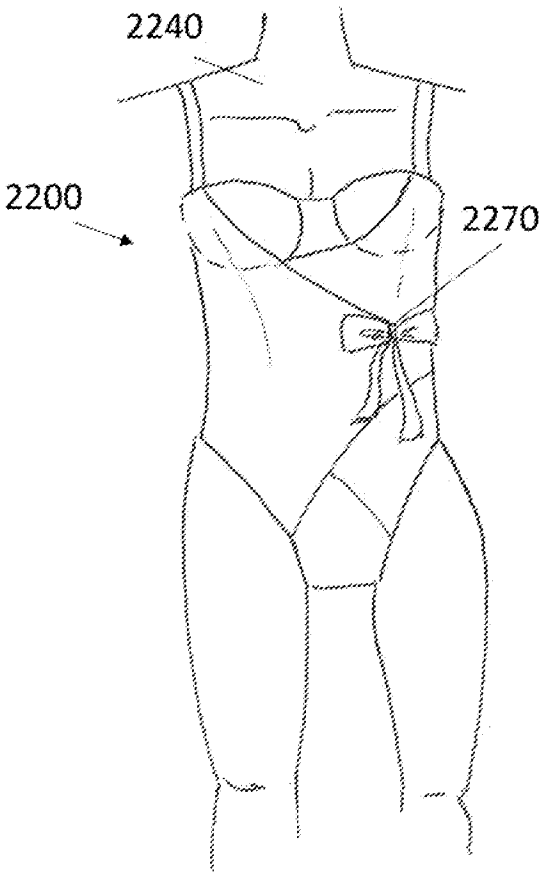
FIG. 22B depicts a front view of the garment of FIG. 22A in a finalized configuration on a wearer.
Figure 22A:
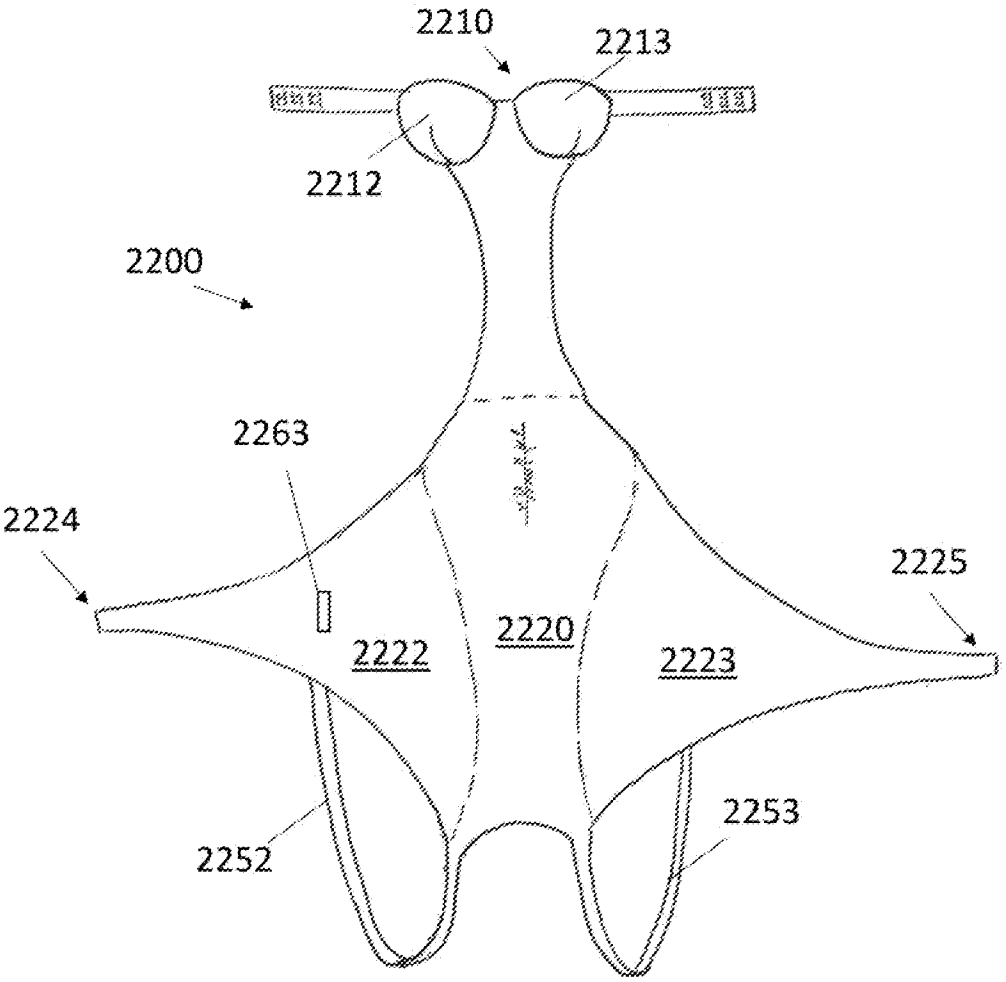
FIG. 22A depicts in plan view the external surfaces of an exemplary single piece Stingray™ bodysuit garment in an extended, flat configuration.
Figure 22E:
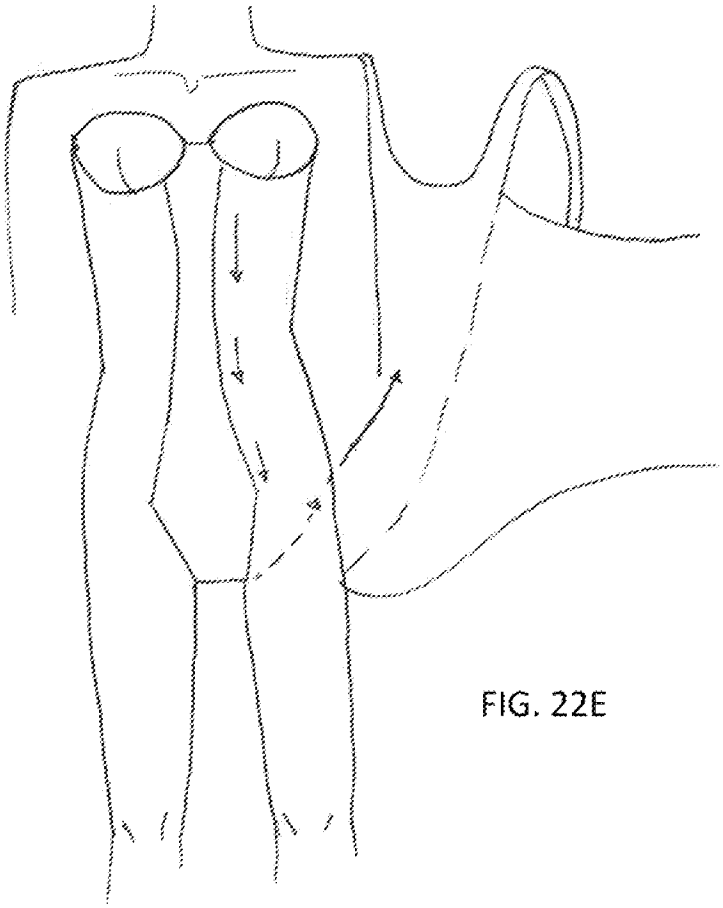
FIG. 22E depicts a front view of the garment of FIGS. 22A-22D during a second donning step.
Figure 22C:
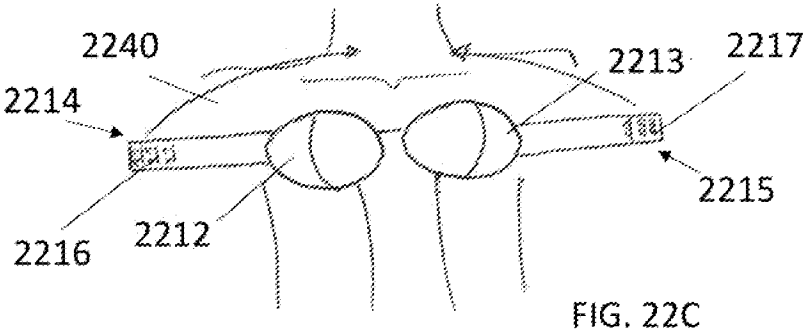
FIG. 22C depicts a front view of a bra portion of the garment of FIGS. 22A-22B in a first donning step.
Figure 22D:
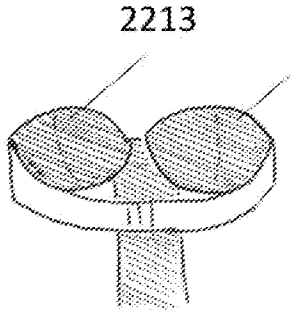
FIG. 22D depicts a back view of the bra portion of the garment of FIGS. 22A-22B after completion of the donning step of FIG. 22C.
Figure 22G:
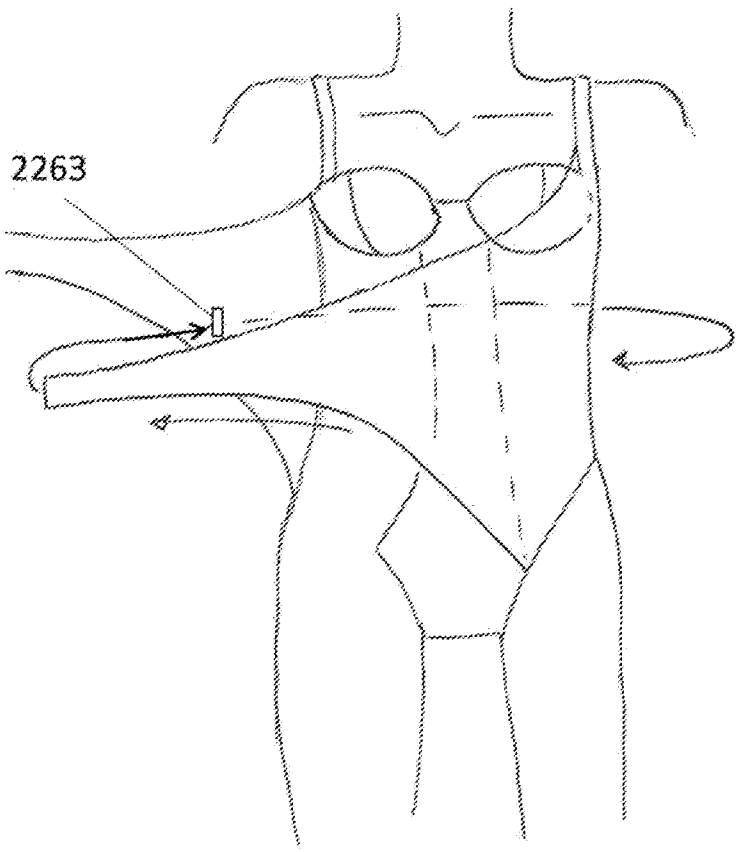
FIG. 22G depicts a front view of the garment of FIGS. 22A-22F during a fourth donning step.
Figure 22F:
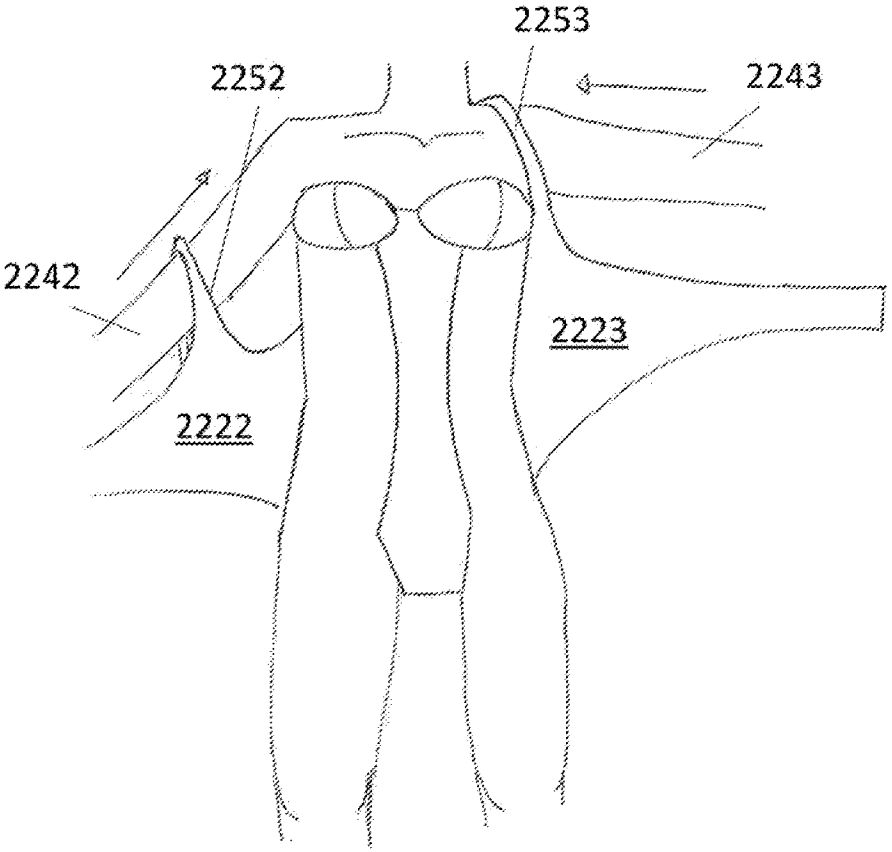
FIG. 22F depicts a front view of the garment of FIGS. 22A-22E during a third donning step.
Figures 23A, 23B, 23C, 23D, 23E, 23F:
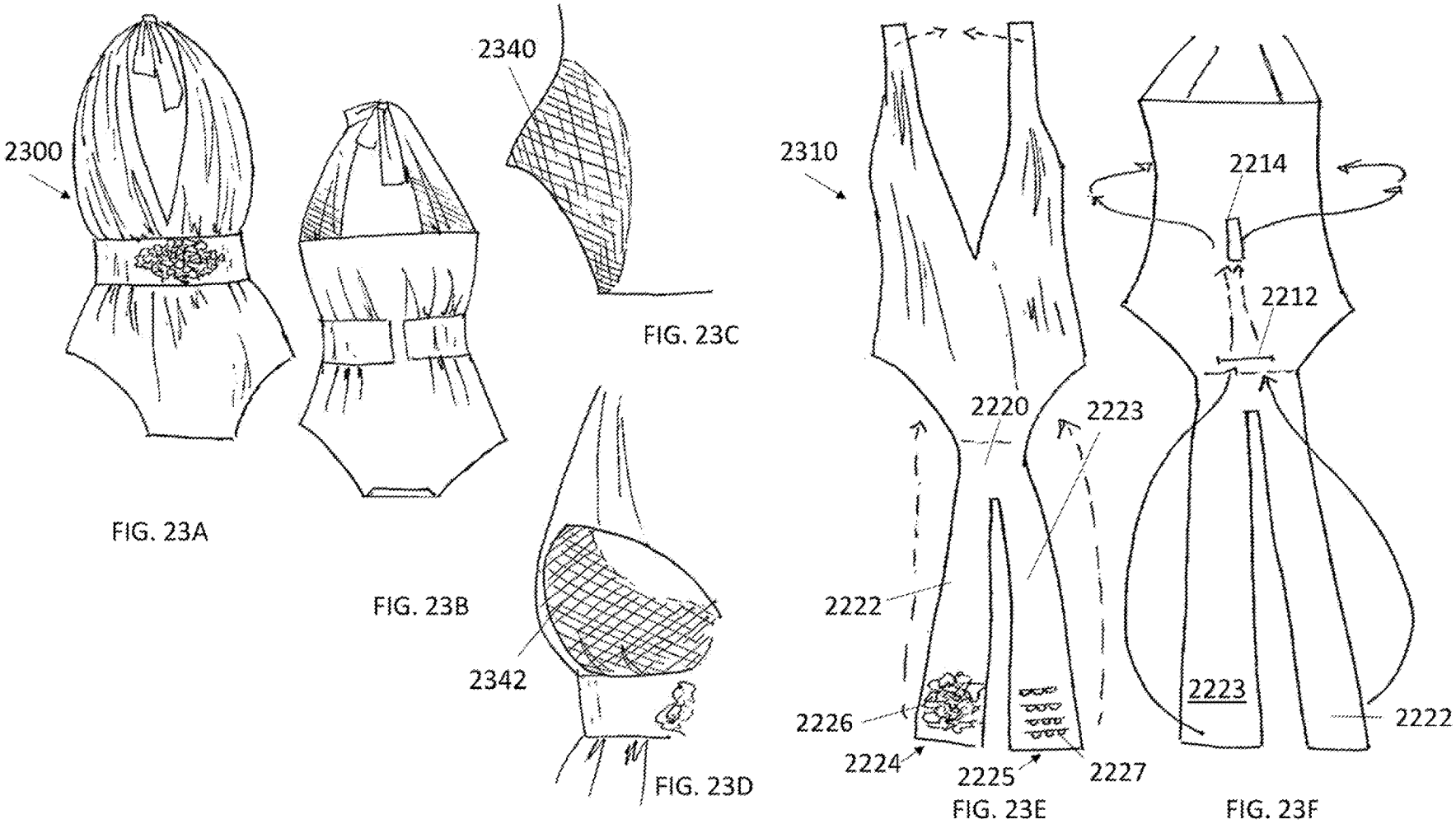
FIG. 23A depicts a front view of an exemplary bodysuit garment in a wearing configuration.
FIG. 23B depicts a back view the garment of FIG. 23A in the wearing configuration.
FIG. 23C depicts a view of a lower padding portion of the garment of FIGS. 23A-23B.
FIG. 23D depicts a view of a bra padding portion of the garment of FIGS. 23A-23B.
FIG. 23E depicts a front view of the garment of FIGS. 23A-23D in an expanded configuration.
FIG. 23F depicts a back view of the garment of FIG. 23E in the expanded configuration.

FIGS. 22A-22G depict a single-piece strapless bra wrap suit embodiment 2200 that may be suitable for a bodysuit or swimwear. Embodiment 2200 comprises a bra section 2210 and a wrap section 2220 that has triangular wing-like flaps 2222, 2223 that resolve to strap-like free ends 2224, 2225 such that the general shape of the garment in the flat configuration depicted in FIG. 22A resembles a stingray. To don the garment, first a wearer places bra cups 2212, 2213 on chest area of the wearer 2240, as shown in FIG. 22C and fastens the opposite ends 2214, 2215 of the bra strap together at a back of the wearer, as depicted in FIG. 22D. Each end 2214, 2215 has a mating fastener portion 2216, 2217, such as hook and eye closures, but the embodiment is not limited to any particular fastener type. The wearer then extends the fabric of the bodysuit down the front of the wearer's body, between the wearer's legs and up the back as shown directionally by the arrows in FIG. 22E. As the fabric is pulled up the back, the wearer's genitals will become compressed. Next the wearer slips their arms 2242, 2243 into the armholes defined by straps 2252, 2253 on the back of the bodysuit. The arrows shown in FIG. 22F reflect the directionality of donning the shoulder straps. The wearer then takes the wings and pulls them across the body to include the chest area for a desired degree of compression. Starting with the wearer's left fabric wing 2223, the user will pull the fabric to the right side of the wearer's body, looping the strap end 2225 of the fabric through opening 2263 and continuing to pull around the back to the right left side of wearer's torso, as depicted in FIG. 22G. The user will then take the right flap 2222 and pull across the left flap 2223. Once the two fabric flaps have been overlapped and adjusted to the desired fit, the free ends 2224 and 2225 of the fabric are secured by tying a decorative bow 2270 to the front left side, as depicted in FIG. 22B. It should be understood that the drawing in FIG. 22B is intended only to be schematic in nature to illustrate the approximate location of the bow and the flaps in a secured position, and that embodiments may have a slightly or substantially different look. In the configuration shown, the left flap (or at least the strap-like portion thereof) is longer than right in order to resolve in the assembled configuration depicted in FIG. 22B. The left may be longer than the right, opening 2263 may be located differently, or the flaps may have the same length in other configurations resulting in a different completed look than that depicted in FIG. 22C, including embodiments in which one or both of the straps extend across the front of the wearer's body. In embodiments, the majority of the garment is constructed from a highly compressive stretch material. The bra portion may include underwire and padding, as is known in the art, and may also have a slightly stretchy band, for ease and comfort, that wraps around the back containing rows of hook and eyes. The shoulder straps may also vary in fabric choice to have more stretch and less compression than the shell of the garment.

Research showed that participants preferred 1920s' unisex, cute, natural, and feminine embodiments, such as those realized by lace design. Briefs, boy shorts, and bikinis were top choices for the cut. For fabric, spandex, modal cotton, or microfiber fabrics were found to be most comfortable. For wearers wanting to achieve a female presentation, techniques such as taping, gaffing, and/or wearing multiple pairs of undergarments may still be employed to realize the desired appearance by compressing the male genitalia. Padding was found to be an acceptable way to flatten the front area and round the back and side areas of the male body to more resemble a female body structure. Participants appreciated that the garments were designed to be adjustable to fit their different body sizes.

As the embodiments are designed to tightly compress the wearer's genitals, fabric that can be both elastic and moisture wicking that can promote air circulation in the areas is preferred. The wear comfort of underwear is strongly associated with fabric, and fabrics having high hygiene, air permeability, and elasticity are preferred. Any of the embodiments disclosed herein, but particularly those referred to herein as incorporating "highly compressive fabric," typically comprise a high compression, low elongation, strong fabric, such as a "power mesh" or "power knit" fabric known in the art, which typically comprises a knit or woven fabric comprising nylon and LYCRA®, spandex, or elastane fiber, and having 4-way stretchability. The invention is not limited to any particular types of fabric, however.

Although shown and described with respect to a number of embodiments, it should be understood that various features in the embodiment may be applicable to other embodiments, and that the invention is not limited to any particular combination of features depicted in the figures and expressly described. Fastener types discussed herein are exemplary only, and the invention is not limited to any particular fastener choice, nor is any embodiment limited to the fastener embodiment depicted. Many of the embodiments depicted herein are shown devoid of certain details, to minimize clutter, whereas other exemplary embodiments are depicted with lace or other aesthetic features. It should be understood that such aesthetic features may be applicable to any of the embodiments shown and discussed herein, and that none of the embodiments are limited by aesthetic details depicted or not depicted. While preferred materials may be discussed herein with respect to certain embodiments, it should be understood that unless expressly stated, the invention is not limited to any particular material or material properties. Certain embodiments may be characterized as underwear, or bodysuits, or swimsuits, but it should be understood that such characterizations are not intended to be limiting, and that no embodiment is limited to any particular use. The functional aspects of the designs as shown herein may be further obscured with additional fabric or garments, including integral pieces, such as fabric transforming an underwear embodiment to a cover-up or a skort.

While some embodiments expressly refer to one or more types of guides (e.g. slits, openings, channels, belt loops, etc.), it should be understood that these embodiments are not limited to any particular type of guide, nor placement nor number thereof. It should be also understood that embodiment depicting guides are not necessarily limited to the presence of guides, nor are embodiments depicted without guides limited to the absence thereof. Guides of any nature may be employed in any of the embodiments having elements that would benefit from the use therefrom.

The figures as depicted herein may be include some aesthetic features as well as functional features. Certain functional aspects may have a large number of equally functional possibilities, but those as depicted herein may be considered particularly aesthetically pleasing or may have ornamental or aesthetic features that may be the subject of design protection. Discussions of functionality herein, or application for design protection of embodiments or portions thereof in separate design applications, do not serve as an admission that any particular feature is only functional or only aesthetic, and to the contrary, it is completed that certain features may be eligible for protection for both their functional and aesthetic/ornamental qualities.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A garment for concealing male genitalia of a wearer, the garment comprising:

a compressible region configured to be disposed over the genitalia of the wearer;

means for adjusting tensile forces exerted on the compressible region, wherein said tensile forces resolve to compression forces exerted by the compressible region on the wearer's genitalia, a primary portion having a front region configured to lie adjacent a front body portion of the wearer and a back region configured to lie adjacent a back body portion of the wearer;

a connector portion configured to connect the front portion to the back portion and having an adjustable length between a connection to the front portion and connection to the back portion, wherein the means for adjusting the tensile forces comprises the adjustable length;

wherein the connector portion is attachable and detachable from the primary portion and comprises a first fastener portion of a front fastener interface on a front end and a first fastener portion of a back fastener interface on a back end;

wherein the primary portion comprises a second fastener portion of the front fastener interface disposed in the front region and a second fastener portion of the back fastener interface disposed in the back region, wherein each first fastener portion is configured to mate with each corresponding second fastener portion; and wherein the front end of the connector portion has bulbous end region and the primary portion front portion comprises a pocket having an opening, the bulbous end region having a width greater than a width of the opening of the pocket and configured to be disposed in the pocket, and a neck region configured to be disposed in the opening or outside of the pocket and having a width equal to or less than the width of the opening in at least a portion of the neck region configured to be disposed in the opening.

2. The garment of claim 1, further comprising lace attached to the primary portion, the connector portion, or both, disposed to hide panty lines, portions of the first fastener interface, portions of the second fastener interface, or a combination thereof.

3. The garment of claim 1, wherein the garment comprises a bottom portion and a top portion.

4. The garment of claim 1, wherein the primary portion comprises a bottom portion and a top portion that form a unitary element and the connector portion has a fixed end attached to the primary portion and at least one free end that is attachable and detachable to the primary portion.

5. The garment of claim 1, wherein at least one of the front fastener interface and the back fastener interface are selected from the group consisting of:

hook and eye fasteners, button and buttonhole fasteners, and microhook/microloop fasteners.

6. The garment claim 1, wherein the front portion of the primary portion has a first design element and the neck region of the connector portion comprises a second design element configured to interact with the first design element to form a completed design having a variable presentation depending upon a position of the front end of the connector relative to the opening.

7. The garment of claim 1, wherein the garment comprises at least one drawstring for adjusting at least one characteristic of the garment.

8. A garment for concealing male genitalia of a wearer, the garment comprising:

a compressible region configured to be disposed over the genitalia of the wearer;

means for adjusting tensile forces exerted on the compressible region, wherein said tensile forces resolve to compression forces exerted by the compressible region on the wearer's genitalia;

a primary portion having a front region configured to lie adjacent a front body portion of the wearer and a back region configured to lie adjacent a back body portion of the wearer;

a connector portion configured to connect the front portion to the back portion and having an adjustable length between a connection to the front portion and connection to the back portion, wherein the means for adjusting the tensile forces comprises the adjustable length, wherein the connector portion has a fixed end attached to the primary portion and at least one free end that is attachable and detachable to the primary portion;

wherein the at least one free end of the connector portion comprises a first fastener portion of a fastener interface, and the primary portion comprises a second fastener portion of the fastener interface, wherein the first fastener portion is configured to mate with the corresponding second fastener portion; and one or more guides disposed in the back of the primary portion and configured to receive and guide the at least one free end of the connector portion to a fastener at a front of the garment.

9. The garment of claim 8, wherein the at least one free end of the connector portion comprises a first fastener portion and second fastener portion of a fastener interface, wherein the first fastener portion is configured to mate with the corresponding second fastener portion, the connector portion fixedly attached to the front of the primary portion and configured to be wrapped medially between a wearer's legs and folded around a waistband of the primary portion in the back of the primary portion, the connector portion folded around the waistband at a location between the first fastener portion and the second fastener portion so that the first fastener portion is in a position to be affixed to the second fastener portion.

10. A garment for concealing male genitalia of a wearer, the garment comprising:

a compressible region configured to be disposed over the genitalia of the wearer;

means for adjusting tensile forces exerted on the compressible region, wherein said tensile forces resolve to compression forces exerted by the compressible region on the wearer's genitalia;

a primary portion having a front region configured to lie adjacent a front body portion of the wearer and a back region configured to lie adjacent a back body portion of the wearer;

a connector portion configured to connect the front portion to the back portion and having an adjustable length between a connection to the front portion and connection to the back portion, wherein the means for adjusting the tensile forces comprises the adjustable length, wherein the connector portion has a fixed end attached to the primary portion and at least one free end that is attachable and detachable to the primary portion; and wherein the connector is bifurcated into a first tie having a first free end and a second tie having a second free end; and wherein the primary portion comprises a first set of guides disposed in the back of the primary portion and configured to receive and guide the first free end of the connector portion to a waistband region of the primary portion and a second set of guides disposed in the back of the primary portion and configured to receive and guide the second free end of the connector portion to the waistband region, wherein the means for adjusting the tension comprises a position of a knot joining the first tie and the second tie in a front of the garment.

11. The garment of claim 10, wherein the first tie and the second tie have different lengths.

12. A garment for concealing male genitalia of a wearer, the garment comprising:

a compressible region configured to be disposed over the genitalia of the wearer:

means for adjusting tensile forces exerted on the compressible region, wherein said tensile forces resolve to compression forces exerted by the compressible region on the wearer's genitalia;

a primary portion having a front region configured to lie adjacent a front body portion of the wearer and a back region configured to lie adjacent a back body portion of the wearer;

a connector portion configured to connect the front portion to the back portion and having an adjustable length between a connection to the front portion and connection to the back portion, wherein the means for adjusting the tensile forces comprises the adjustable length;

wherein the primary portion comprises a bottom portion and a top portion that form a unitary element and the connector portion has a fixed end attached to the primary portion and at least one free end that is attachable and detachable to the primary portion; and wherein the connector portion is bifurcated into a first strap having a first free end and a second strap having a second free end, wherein the connector portion is configured to be disposed between the wearer's legs and adjacent a portion of the wearer's back, with the first strap and the second strap wrapped from back to front and secured to one another in the front in a waist region of the user.

13. The garment of claim 12, wherein the primary portion comprises one or more guides for guiding the first strap and the second strap from a bottom back of the primary portion to the waist region.

14. The garment of claim 13, wherein the one or more guides comprises a first slit for receiving the connector portion adjacent a bottom back of the wearer and a second and third slits in the waist region of the user adjacent opposite sides of the back of the user for respectively receiving the first strap and the second strap.

15. The garment of claim 13, wherein the first strap comprises a first portion of an adjustable fastener interface and the second strap comprises a second portion of the adjustable fastener interface.

16. The garment of claim 15, wherein the one or more guides comprises a first slit for receiving the connector portion adjacent a bottom back center of the wearer and a second slit in the waist region of the user adjacent a center of the back of the user for receiving both the first strap and the second strap.

17. A garment for concealing male genitalia of a wearer, the garment comprising:

a compressible region configured to be disposed over the genitalia of the wearer;

means for adjusting tensile forces exerted on the compressible region, wherein said tensile forces resolve to compression forces exerted by the compressible region on the wearer's genitalia; and one or more padding pockets for receiving padding, and one or more pads configured to be disposed in the one or more pockets, wherein the means for adjusting the tensile forces consist of the one or more pads disposed in the one or more padding pockets, wherein selection of relatively greater thickness of the one or more pads results in relatively greater tensile forces.

18. The garment of claim 17, wherein the one or more padding pockets includes a front pocket, a left side pocket, a right side pocket, a right rear pocket, and a left rear pocket.

19. The garment of claim 17, wherein the one or more pads comprises a stitched or quilted fabric pad.

20. A garment for concealing male genitalia of a wearer, the garment comprising:

a compressible region configured to be disposed over the genitalia of the wearer;

means for adjusting tensile forces exerted on the compressible region, wherein said tensile forces resolve to compression forces exerted by the compressible region on the wearer's genitalia; and an internal fabric catcher configured to be disposed over the wearer's genitalia, the catcher configured with a plurality of channels, including a channel on each lateral side, and a drawstring in each channel, the catcher connected to an internal top front of the garment at one end, extending between the legs of the wearer, and attached to an internal back top at an opposite end, each drawstring having free ends extending outside the channels on opposite lateral sides of respective leg holes in the garment, the garment further comprising a drawstring closure proximal of each drawstring end, wherein the means for adjusting the tensile force comprises a location of drawstring closure relative to the free ends of the drawstrings.

* * * * *